US010937573B2

(12) United States Patent
Shinoura

(10) Patent No.: US 10,937,573 B2
(45) Date of Patent: Mar. 2, 2021

(54) CHIP RESISTOR

(71) Applicant: ROHM CO., LTD., Kyoto (JP)

(72) Inventor: Takanori Shinoura, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/756,413

(22) PCT Filed: Oct. 11, 2018

(86) PCT No.: PCT/JP2018/037849
§ 371 (c)(1),
(2) Date: Apr. 15, 2020

(87) PCT Pub. No.: WO2019/087725
PCT Pub. Date: May 9, 2019

(65) Prior Publication Data

US 2020/0328014 A1 Oct. 15, 2020

(30) Foreign Application Priority Data

Nov. 2, 2017 (JP) ..... JP2017-212427

(51) Int. Cl.
*H01C 1/14* (2006.01)
*H01C 1/01* (2006.01)
*H01C 17/00* (2006.01)

(52) U.S. Cl.
CPC ..... *H01C 1/14* (2013.01); *H01C 1/01* (2013.01); *H01C 17/006* (2013.01)

(58) Field of Classification Search
CPC ..... H01C 1/14; H01C 1/01; H01C 17/006
See application file for complete search history.

(56) References Cited

U.S. PATENT DOCUMENTS 6,023,217 A * 2/2000 Yamada ..... H01C 1/142 338/307
6,492,896 B2 * 12/2002 Yoneda ..... H01C 7/003 338/195

(Continued)

FOREIGN PATENT DOCUMENTS

JP 11-26205 A 1/1999
JP 2000-138102 A 5/2000

(Continued)

OTHER PUBLICATIONS

International Search Report issued in PCT/JP2018/037849, dated Jan. 8, 2019 (2 pages).

*Primary Examiner* — Kyung S Lee
(74) *Attorney, Agent, or Firm* — Hamre, Schumann, Mueller & Larson, P.C.

(57) ABSTRACT

A chip resistor includes a substrate, a resistor layer, a first conductive layer, an insulating layer, a second conductive layer, a third conductive layer, and a fourth conductive layer. The first conductive layer is electrically connected to the resistor layer. The insulating layer covers the resistor layer and the first conductive layer. The second conductive layer covers the first conductive layer and the insulating layer. The third conductive layer covers the second conductive layer and the insulating layer. The fourth conductive layer covers the second conductive layer and the third conductive layer. Bonding strength between the third and fourth conductive layer is stronger than that between the second and fourth conductive layer.

19 Claims, 20 Drawing Sheets

(56) References Cited

U.S. PATENT DOCUMENTS

| | | | | |
|---|---|---|---|---|
| 7,786,842 | B2 * | 8/2010 | Tsukada | H01C 17/006 338/309 |
| 8,193,899 | B2 * | 6/2012 | Takeuchi | H01C 17/06506 338/262 |
| 8,957,756 | B2 * | 2/2015 | Belman | H01C 1/034 338/307 |
| 9,997,281 | B2 * | 6/2018 | Shinoura | H01C 1/142 |
| 2004/0262712 | A1 * | 12/2004 | Doi | H01C 17/006 257/536 |
| 2020/0066429 | A1 * | 2/2020 | Imahashi | H01C 17/065 |

FOREIGN PATENT DOCUMENTS

| | | | |
|---|---|---|---|
| JP | 2009-158721 | A | 7/2009 |
| JP | 2016-157980 | a | 9/2016 |

* cited by examiner

FIG.23
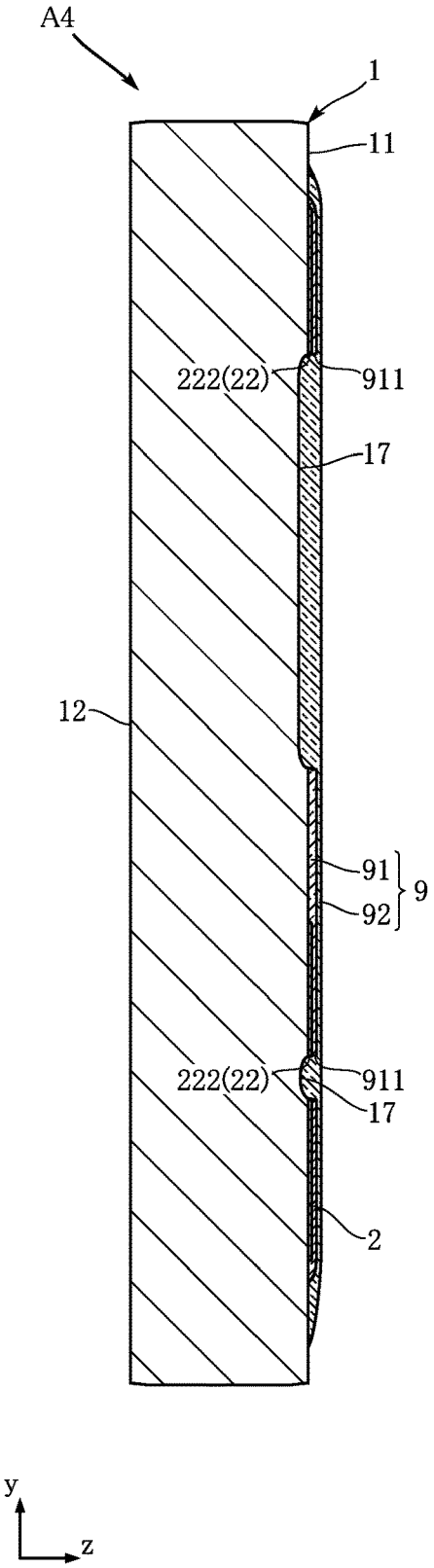
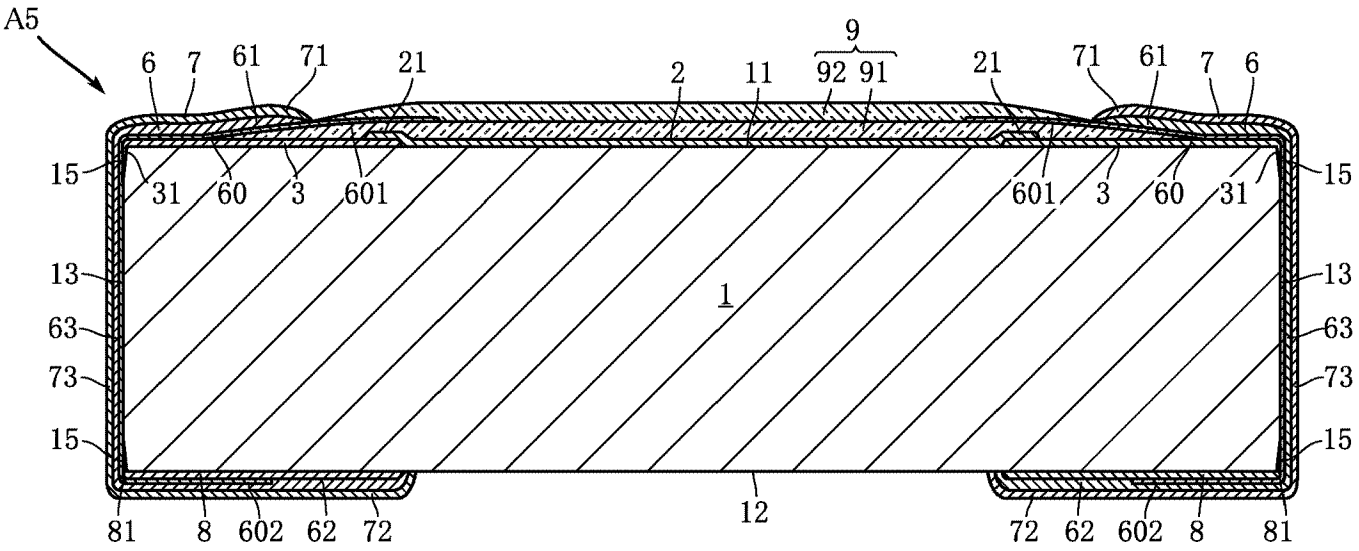
FIG.24

CHIP RESISTOR

TECHNICAL FIELD

The present disclosure relates to a chip resistor.

BACKGROUND ART

One example of a conventional chip resistor is provided with a substrate, a resistor layer, a conductive layer, a plating layer, and an insulating layer. The resistor layer is formed on the obverse surface of the substrate. The conductive layer is electrically connected to the resistor layer by contacting the resistor layer. The insulating layer covers all of the resistor layer and part of the conductive layer. The plating layer covers a portion of the conductive layer that is exposed from the insulating layer.

SUMMARY OF THE INVENTION

According to one aspect of the present disclosure, a chip resistor is provided. The chip resistor includes a substrate, a resistor layer, a first conductive layer, an insulating layer, a second conductive layer, a third conductive layer, and a fourth conductive layer. The substrate has an obverse surface and a reverse surface facing opposite to each other in a thickness direction, and also has a side surface located between the obverse surface and the reverse surface. The resistor layer is disposed on the obverse surface. The first conductive layer is disposed on the obverse surface, and is electrically connected to the resistor layer. The insulating layer covers the resistor layer and the first conductive layer, and has a first edge located on the first conductive layer. The second conductive layer covers the first conductive layer and the insulating layer while straddling over the first edge, and has a second edge located on the insulating layer. The third conductive layer covers the second conductive layer and the insulating layer while straddling over the second edge, and has a third edge located on the second conductive layer. The fourth conductive layer covers the second conductive layer and the third conductive layer while straddling over the third edge. The bonding strength between the third conductive layer and the fourth conductive layer is stronger than the bonding strength between the second conductive layer and the fourth conductive layer.

Other features and advantages of the present disclosure will be made more clear by the following detailed description based on the accompanying drawings.

BRIEF DESCRIPTION OF DRAWINGS

FIG. 11 is a cross-sectional view taken along line XI-XI in

FIG. 9.

FIG. 23 is a cross-sectional view taken along line XXIII-XXIII in FIG. 18.

FIG. 24 is a cross-sectional view showing a chip resistor according to a fifth embodiment of the present disclosure.

MODE FOR CARRYING OUT THE INVENTION

Figure 1:
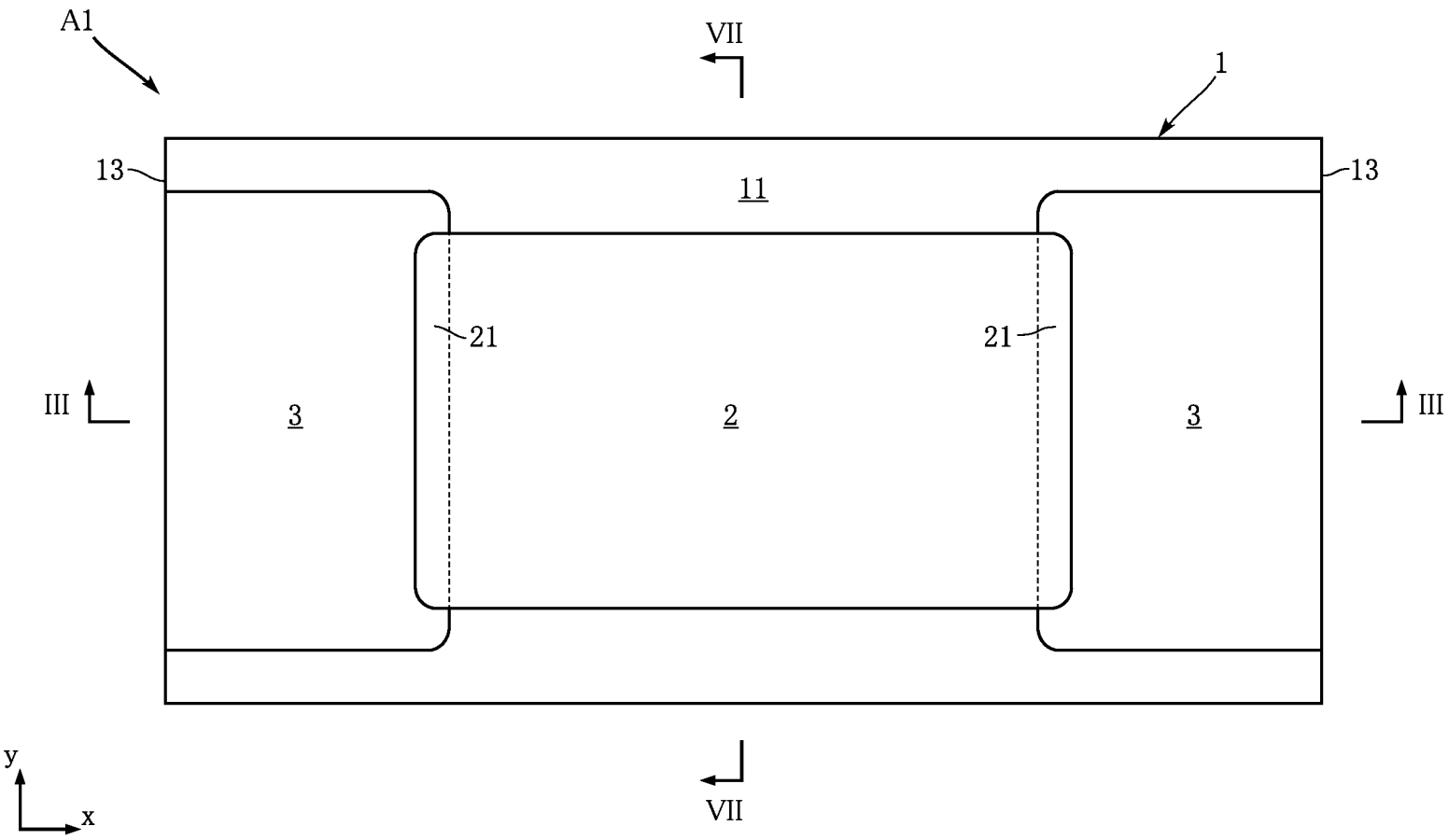
FIG. 1 is a main part plan view showing a chip resistor according to a first embodiment of the present disclosure.

The following describes modes for implementing the present disclosure with reference to the accompanying drawings.

Terms such as "first", "second", and "third" in the present disclosure are simply used as labels, and are not intended to assign a sequence for those terms.

FIGS. 1 to 7 show a chip resistor according to a first embodiment of the present disclosure. A chip resistor A1 of this embodiment includes a substrate 1, a resistor layer 2, a pair of first conductive layers 3, a pair of second conductive layers 4, a pair of third conductive layers 5, a pair of fourth conductive layers 6, a pair of fifth conductive layers 7, and an insulating layer 9.

Figure 2:
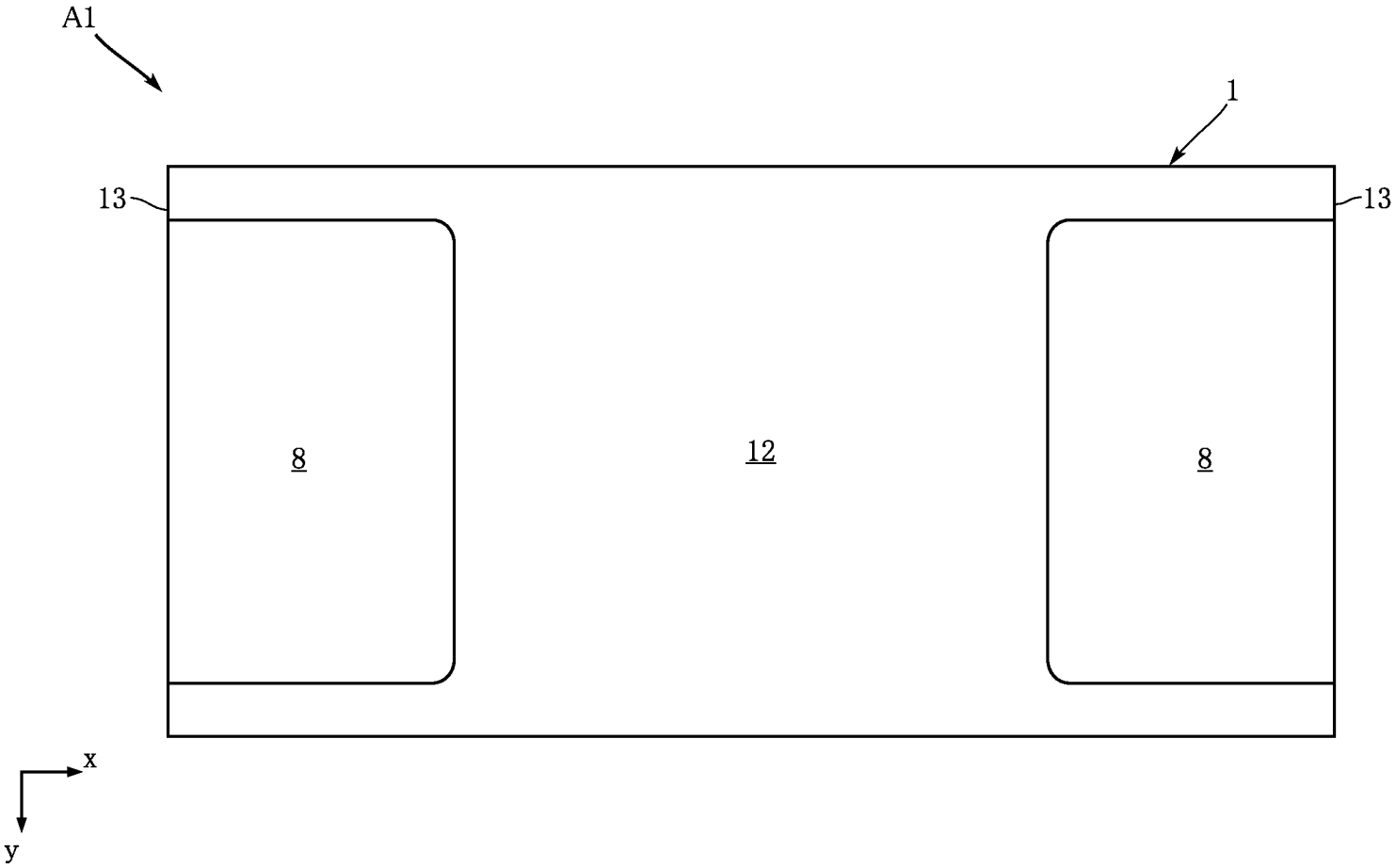
FIG. 2 is a main part bottom view showing the chip resistor according to a first embodiment of the present disclosure.
Figure 3:
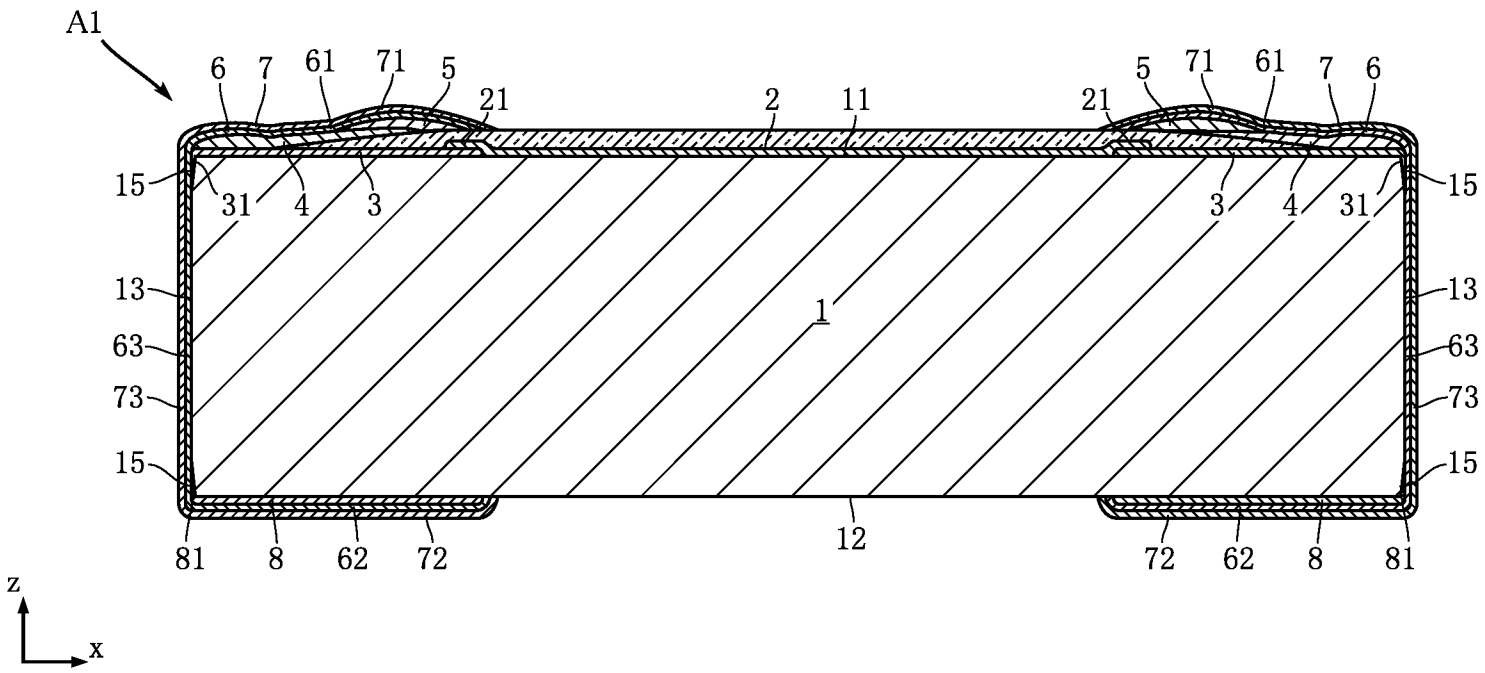
FIG. 3 is a cross-sectional view taken along line III-III in FIG. 1.
Figure 4:
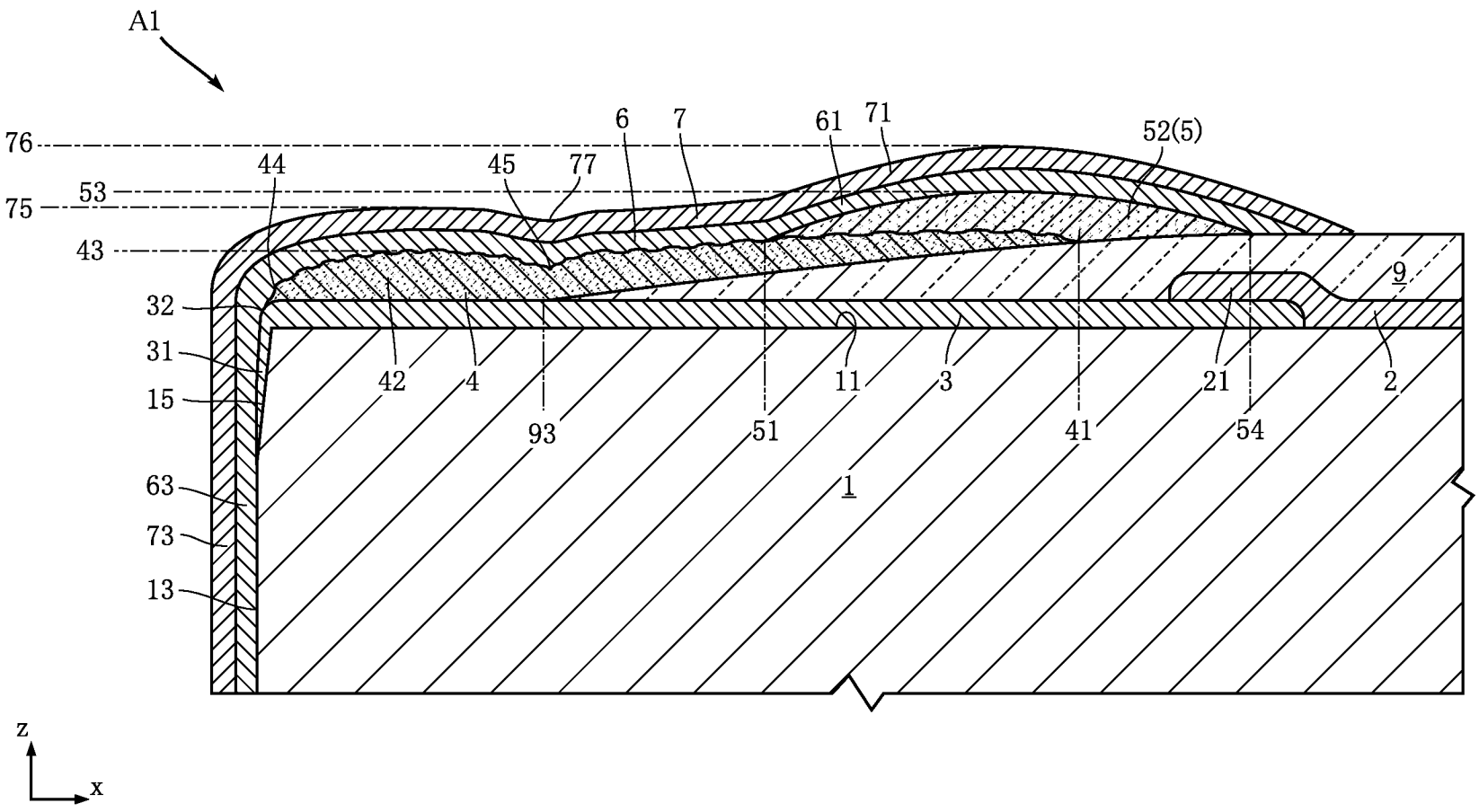
FIG. 4 is a main part enlarged cross-sectional view showing the chip resistor according to a first embodiment of the present disclosure.
Figure 5:
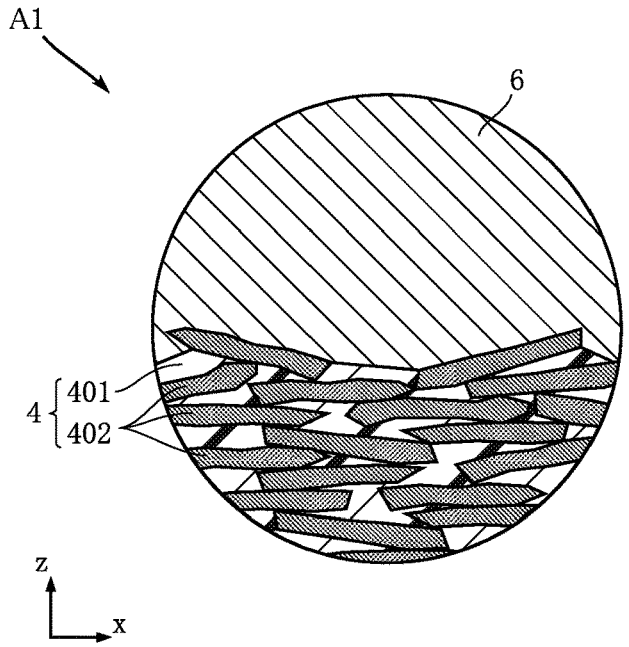
FIG. 5 is a main part enlarged cross-sectional view showing the chip resistor according to a first embodiment of the present disclosure.
Figure 6:
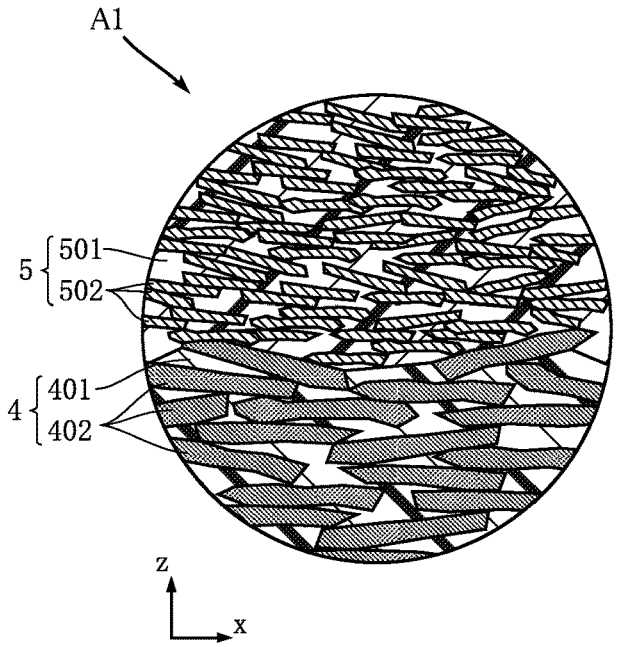
FIG. 6 is a main part enlarged cross-sectional view showing the chip resistor according to a first embodiment of the present disclosure.
Figure 7:
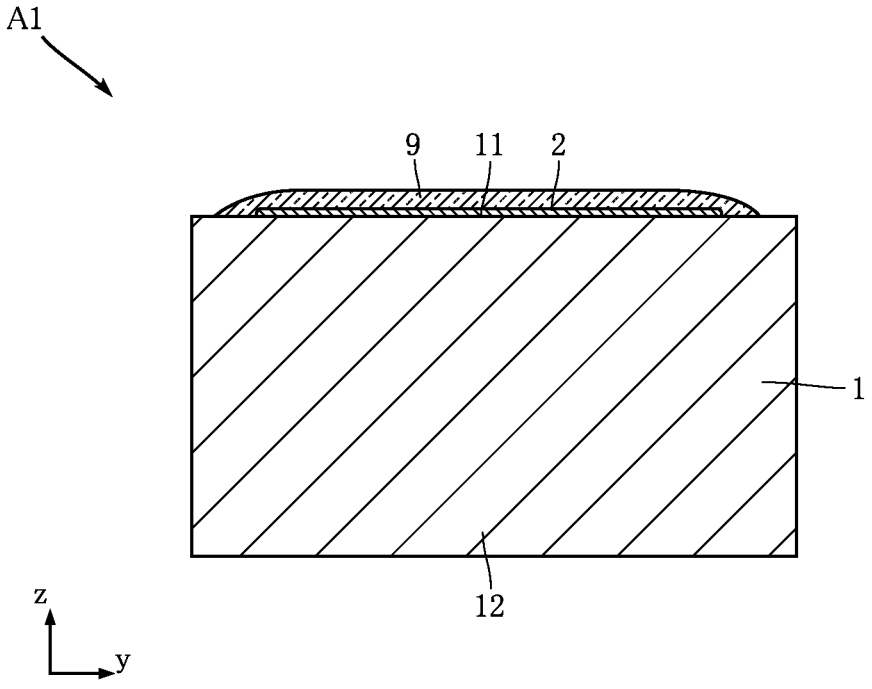
FIG. 7 is a cross-sectional view taken along line VII-VII in FIG. 1.

FIG. 1 is a plan view showing the chip resistor A1. FIG. 2 is a bottom view showing the chip resistor A1. FIG. 3 is a cross-sectional view taken along line III-III in FIG. 1. FIG. 4 is a main part enlarged cross-sectional view showing the chip resistor A1. FIG. 5 is a main part enlarged cross-sectional view showing the chip resistor A1. FIG. 6 is a main part enlarged cross-sectional view showing the chip resistor A1. FIG. 7 is a cross-sectional view taken along line VII-VII in FIG. 1. Note that in FIG. 1, for convenience of understanding, components other than the substrate 1, the resistor layer 2, and the first conductive layers 3 are omitted, and in FIG. 2, components other than the substrate 1 and sixth conductive layers 8 are omitted. In these drawings, the thickness direction of the substrate 1 of the chip resistor A1 is the z direction. The x direction and the y direction are directions that are each perpendicular to the z direction. A view in the z direction may be referred to as a plan view for convenience.

The substrate 1 supports the resistor layer 2, the pair of first conductive layers 3, the pair of second conductive layers 4, the pair of third conductive layers 5, the pair of fourth conductive layers 6, the pair of fifth conductive layers 7, and the insulating layer 9. The substrate 1 has an obverse surface 11, a reverse surface 12, and a pair of side surfaces 13. In the example shown, the substrate 1 has a substantially rectangular parallelepiped shape. Further, in the example shown, the substrate 1 has a long rectangular shape where the x direction is the longitudinal direction and the y direction is the transverse direction. At least the surface of the substrate 1 has insulating properties, and the substrate 1 is commonly formed from an insulating material. Examples of the material of the substrate 1 include ceramics such as $Al_2O_3$ and AlN. The size of the substrate 1 is not particularly limited, and in one example, the dimensions of the substrate 1 in the x direction and the y direction are about 0.2 mm to 4 mm, and the dimensions in the z direction are about 0.1 to 0.8 mm.

The obverse surface 11 and the reverse surface 12 are surfaces facing opposite sides of each other in the z direction. The pair of side surfaces 13 face opposite sides of each other in the x direction, and each of the pair of side surfaces 13 is located between the obverse surface 11 and the reverse surface 12. In the example shown, the substrate 1 has a plurality of inclined surfaces 15. The inclined surfaces 15 are interposed between the side surface 13 and one of the obverse surface 11 and the reverse surface 12. The inclined surfaces 15 are inclined with respect to the z direction. The inclined surfaces 15 are formed, for example, where there remains a part of a groove provided in order to divide a substrate material for forming the substrate 1.

The resistor layer 2 is disposed on the obverse surface 11 of the substrate 1 and is a portion that defines the resistance value of the chip resistor A1. The shape of the resistor layer 2 is not particularly limited, and in the example shown, is a substantially rectangular shape having two pairs of sides in the x direction and the y direction as shown in FIG. 1. In the example shown, the resistor layer 2 is spaced inward from the outer edges of the substrate 1 when viewed in the z direction.

The material of the resistor layer 2 is not particularly limited, and a material such that it is possible to realize a resistance value required for the chip resistor A1 may be appropriately adopted. The material of the resistor layer 2 is, for example, a material containing $RuO_2$ or an Ag—Pd alloy, and this material may further contain glass. The thickness of the resistor layer 2 is not particularly limited, and is, for example, 5 μm to 10 μm, and preferably is 7 μm to 8 μm. Such a resistor layer 2 is formed by, for example, printing a paste containing metal particles of $RuO_2$ or an Ag—Pd alloy or the like and fritted glass on a substrate material serving as the material of the substrate 1 using a silk screen or the like, and baking this paste.

The pair of first conductive layers 3 are disposed on the obverse surface 11, and are provided on both sides in the x direction with the resistor layer 2 interposed therebetween. The first conductive layers 3 are electrically connected to the resistor layer 2. As shown in FIG. 4, in the example shown, the resistor layer 2 has a covering portion 21. The covering portion 21 is a portion that covers the first conductive layers 3. Thus, the first conductive layers 3 are electrically connected to the resistor layer 2. As shown in FIG. 1, in the example shown, the first conductive layers 3 have a substantially rectangular shape when viewed in the z direction. Further, the first conductive layers 3 reach the side surfaces 13 when viewed in the z direction. The first conductive layers 3 are separated from the edge of the substrate 1 in the y direction. In the example shown, the first conductive layers 3 have an inclined covering portion 31 and a curved surface portion 32. The inclined covering portion 31 is a portion that covers the inclined surfaces 15 of the substrate 1. The curved surface portion 32 is a portion formed of a convex curved surface located above the inclined covering portion 31 in the z direction.

The material of the first conductive layers 3 is not particularly limited, and a material that is appropriately conductive with the resistor layer 2 and has a lower electrical resistivity than the material of the resistor layer 2 can be selected. Examples of the material of the first conductive layers 3 include a mixed material containing Ag and glass. The thickness of the first conductive layers 3 is not particularly limited, and is, for example, 5 to 12 μm, and preferably 7 to 10 μm. Such first conductive layers 3 are formed by, for example, printing a paste containing Ag particles and fritted glass on a substrate material serving as the material of the substrate 1 using a silk screen or the like, and baking this paste.

The insulating layer 9 covers the resistor layer 2 and the pair of first conductive layers 3 to protect them. In the example shown, the insulating layer 9 covers all of the resistor layer 2 and a part of each of the pair of first conductive layers 3. The insulating layer 9 has a first edge 93. The first edge 93 is an edge located on the first conductive layers 3 and extending in the y direction. As shown in FIG. 7, in the example shown, the insulating layer 9 does not reach the edge of the substrate 1 in the y direction, but a configuration may be adopted in which the insulating layer 9 reaches the edge of the substrate 1 in the y direction.

The insulating layer 9 is formed from a single layer or a plurality of layers of insulating material. Examples of the material of the insulating layer 9 include a glass layer and an epoxy resin. The thickness of the insulating layer 9 is not particularly limited, and is, for example, 15 to 40 μm. As shown in FIG. 4, in the example shown, the insulating layer 9 has a shape having a portion where the thickness in the z direction gradually decreases from the center in the x direction toward the first edge 93. Such an insulating layer 9 is formed by, for example, printing a glass paste on the resistor layer 2 and the first conductive layers 3 using a silk screen or the like, and baking this paste.

The pair of second conductive layers 4 are provided separated from each other in the x direction. The second conductive layers 4 cover the first conductive layers 3 and the insulating layer 9 while straddling over the first edge 93 of the insulating layer 9. In the example shown, the second conductive layers 4 cover a portion of the first conductive layers 3 exposed from the first conductive layers 3 and a part of the insulating layer 9. Also, in the example shown, the second conductive layers 4 expose the curved surface portion 32 of the first conductive layers 3. The second conductive layers 4 have a second edge 41. The second edge 41 is located on the insulating layer 9 and extends in the y direction. The second edge 41 is located closer to the center in the x direction than the first edge 93.

The second conductive layers 4 have a second bulging portion 42 and a curved surface portion 44. The second bulging portion 42 is a portion having a shape bulging away from the substrate 1 in the z direction, and is located substantially closer to the side surface 13 of the substrate 1 than the first edge 93 in the x direction. A peak 43 is a portion of the second bulging portion 42 that is farthest from the substrate 1 in the z direction. A concave portion 45 is an end portion in the x direction of the second bulging portion 42, and is a concave portion located substantially on the first edge 93. The curved surface portion 44 is a portion adjacent to the curved surface portion 32 of the first conductive layers 3 upward in the z direction, and is a portion formed of a convex curved surface.

The material of the second conductive layers 4 is not particularly limited, and a material that is appropriately conductive with the first conductive layers 3 and has a lower electrical resistivity than the material of the resistor layers can be selected. Examples of the material of the second conductive layers 4 include a mixed material containing conductive particles and a synthetic resin. The conductive particles are, for example, carbon particles. In addition, the shape of the carbon particles is not particularly limited, and examples include a spherical shape and a flake-like shape. As shown in FIGS. 5 and 6, in the example shown, the second conductive layers 4 contain flake-like carbon particles. These carbon particles have, for example, a dimension in the longitudinal direction perpendicular to the thickness direction of about 5 to 15 μm and a dimension in the transverse direction of about 2 to 5 μm. Further, since the second conductive layers 4 contain flake-like carbon particles, the surface of the second conductive layers 4 has an uneven shape. The thickness of the second conductive layers 4 is not particularly limited, and is, for example, 10 to 25 μm, and preferably 12 to 15 μm. Such second conductive layers 4 are formed, for example, by printing a paste containing flake-like carbon particles and mainly containing a flexible epoxy resin on the first conductive layers 3 and the insulating layer 9 using a silk screen or the like, and baking this paste.

The pair of third conductive layers 5 are provided separated from each other in the x direction. The third conductive layers 5 cover the second conductive layers 4 and the insulating layer 9 while straddling over the second edge 41 of the second conductive layers 4. In the example shown, the third conductive layers 5 cover part of the second conductive layers 4 and part of the insulating layer 9. The third conductive layers 5 have a third edge 51 and a fourth edge 54. The third edge 51 is located on the second conductive layers 4 and extends in the y direction. The fourth edge 54 is located on the insulating layer 9 and extends in the y direction. In the example shown, the third edge 51 is located between the first edge 93 of the insulating layer 9 and the second edge 41 of the second conductive layers 4 in the x direction.

The third conductive layers 5 have a third bulging portion 52, and in the example shown, the third conductive layers 5 are formed from the third bulging portion 52. The third bulging portion 52 is a portion having a shape bulging away from the substrate 1 in the z direction. A peak 53 is a portion of the third bulging portion 52 that is farthest from the substrate 1 in the z direction. In the example shown, the peak 53 is farther from the substrate 1 than the peak 43 in the z direction. The thickness of the portion of the third bulging portion 52 that includes the peak 53 is greater than the thickness of the portion of the second conductive layers 4 covered by the third bulging portion 52.

The material of the third conductive layers 5 is not particularly limited, and a material that is appropriately conductive with the second conductive layers 4 and has a lower electrical resistivity than the material of the resistor layers can be selected. Examples of the material of the third conductive layers 5 include a mixed material containing conductive particles and a synthetic resin. The conductive particles are, for example, Ag particles. In addition, the shape of the Ag particles is not particularly limited, and examples include a spherical shape and a flake-like shape. As shown in FIG. 6, in the example shown, the third conductive layers 5 contain a synthetic resin 501 and flake-like metal particles 502. These metal particles 502 have, for example, a dimension in the longitudinal direction perpendicular to the thickness direction of about 5 to 15 μm and a dimension in the transverse direction of about 2 to 5 μm, and in the example shown, these dimensions are less than those of the carbon particles 402 of the second conductive layers 4. Further, since the third conductive layers 5 contain the flake-like metal particles 502, the surface of the third conductive layers 5 has an uneven shape. Such third conductive layers 5 are formed, for example, by printing a paste containing flake-like Ag particles and mainly containing a flexible epoxy resin on the second conductive layers 4 and the insulating layer 9 using a silk screen or the like, and baking this paste.

The pair of sixth conductive layers 8 are disposed on the reverse surface 12 and provided on both sides in the x direction. As shown in FIG. 2, in the example shown, the sixth conductive layers 8 have a substantially rectangular shape when viewed in the z direction. In addition, the sixth conductive layers 8 reach the side surfaces 13 when viewed in the z direction. The sixth conductive layers 8 are separated from the edge of the substrate 1 in the y direction. In the example shown, the sixth conductive layers 8 have an inclined covering portion 81. The inclined covering portion 81 is a portion that covers the inclined surfaces 15 of the substrate 1.

The material of the sixth conductive layers 8 is not particularly limited, and a material that has a lower electrical resistivity than the material of the resistor layers 2 can be selected. Examples of the material of the sixth conductive layers 8 include a mixed material containing Ag and glass. The thickness of the sixth conductive layers 8 is not particularly limited, and is, for example, 5 to 12 μm, and preferably 7 to 10 μm. Such sixth conductive layers 8 are formed, for example, by printing a paste containing Ag particles and flitted glass on a substrate material serving as the material of the substrate 1 using a silk screen or the like, and baking this paste.

The pair of fourth conductive layers 6 are provided on both sides in the x direction. As shown in FIG. 3, the fourth conductive layers 6 have an obverse surface portion 61, a reverse surface portion 62, and a side surface portion 63. The obverse surface portion 61 is a portion supported by the obverse surface 11 through the first conductive layers 3, the second conductive layers 4, the third conductive layers 5, the insulating layer 9, and the like. The reverse surface portion 62 is a portion supported by the reverse surface 12 through the sixth conductive layers 8, and covers the sixth conductive layers 8. The side surface portion 63 is a portion formed on the side surfaces 13.

As shown in FIG. 4, the obverse surface portion 61 of the fourth conductive layers 6 covers the second conductive layers 4 and the third conductive layers 5, and in the examples shown, covers all of the second conductive layers 4 and the third conductive layers 5. Thus, the fourth edge 54 of the third conductive layers 5 is covered by the fourth conductive layers 6. Further, a part of the obverse surface portion 61 of the fourth conductive layers 6 is located on the insulating layer 9.

The fourth conductive layers 6 are formed of a single metal layer or a plurality of metal layers. Examples of a metal layer include a metal layer formed by a thin film forming technique such as sputtering and a metal layer formed by plating. In the example shown, the metal layers include an underlayer formed by sputtering (not shown) and a plating layer (not shown) formed on the underlayer. The material of the fourth conductive layers 6 is not particularly limited, and examples of the material include metals such as Ni and Cr or alloys containing these. The thickness of fourth conductive layers 6 is, for example, 3 μm to 7 μm. The fourth conductive layers 6 have a shape conforming to the surface shape of the substrate 1, the second conductive layers 4, the third conductive layers 5, and the sixth conductive layers 8.

The material of the second conductive layers 4, the third conductive layers 5, and the fourth conductive layers 6 can be selected such that the bonding strength between the third conductive layers 5 and the fourth conductive layers 6 is stronger than the bonding strength between the second conductive layers 4 and the fourth conductive layers 6. In the above-described example, it is thought that when the synthetic resins contained in the second conductive layers 4 and the third conductive layers 5 have the same composition, the carbon particles 402 contained in the second conductive layers 4 exhibit a function of increasing the bonding strength with the fourth conductive layers 6 more than the metal particles 502 contained in the third conductive layers 5.

The pair of fifth conductive layers 7 are provided on both sides in the x direction. As shown in FIG. 3, the fifth conductive layers 7 have an obverse surface portion 71, a reverse surface portion 72, and a side surface portion 73. The obverse surface portion 71 is a portion supported by the obverse surface 11 through the first conductive layer 3, the second conductive layers 4, the third conductive layers 5, the fourth conductive layers 6, the insulating layer 9, and the like. The reverse surface portion 72 is a portion supported by the reverse surface 12 through the fourth conductive layers 6 and the sixth conductive layers 8, and covers the reverse surface portion 62 of the fourth conductive layers 6. The side surface portion 73 is a portion supported by the side surfaces 13 through the fourth conductive layers 6 and covers the side surface portion 63 of the fourth conductive layers 6.

As shown in FIG. 4, the obverse surface portion 71 of the fifth conductive layers 7 covers the obverse surface portion 61 of the fourth conductive layers 6, and in the example shown, covers the entire obverse surface portion 61. Further, a part of the obverse surface portion 71 of the fifth conductive layers 7 is located on the insulating layer 9.

The fifth conductive layers 7 are formed of a single metal layer or a plurality of metal layers. A metal layer is, for example, a metal such as Sn or an alloy containing this metal. The thickness of fourth conductive layers 6 is, for example, 3 μm to 7 μm. The fifth conductive layers 7 are formed by depositing Sn by, for example, electrolytic barrel plating.

The fifth conductive layers 7 have a shape conforming to the surface shape of the fourth conductive layers 6. As shown in FIG. 4, the obverse surface portion 71 of the fifth conductive layers 7 has a peak 75, a peak 76, and a concave portion 77. The peak 75 is a portion that is located substantially on the peak 43 of the second bulging portion 42 of the second conductive layers 4. The peak 76 is a portion that is located substantially on the peak 53 of the third bulging portion 52 of the third conductive layers 5. The concave portion 77 is a portion that is located substantially on the first edge 93 of the insulating layer 9 and the concave portion 45 of the second conductive layers 4. That is, the concave portion 77 is located between the peak 75 and the peak 76 in the x direction. The concave portion 77 is a portion that is recessed in the z direction between the peaks 75 and 76. The peak 75 is a portion that is farthest from the substrate 1 in the z direction between the concave portion 77 and the side surface 13. The peak 76 is a portion that is farthest from the substrate 1 in the z direction, on the center in the x direction relative to the concave portion 77. In the example shown, the peak 76 is farther from the substrate 1 in the z direction than the peak 75. The peak 75 is closer to the substrate 1 in the z direction than the peak 75 and the peak 76. The peak 76 is located at a position overlapping the insulating layer 9 when viewed in the z direction.

Next, operation of the chip resistor A1 will be described.

According to the present embodiment, as shown in FIG. 4, the second edge 41 of the second conductive layer 4 is covered by the third conductive layers 5. Thus, it is possible to suppresses external gas, liquid, and the like that may exist depending on the use environment from entering the first conductive layers 3 from the second edge 41, which is the boundary between the second conductive layers 4 and the insulating layer 9. Thus, it is possible to suppress alteration or the like of the first conductive layers 3, and it is possible to avoid poor conduction or the like of the first conductive layers 3. Also, the bonding strength of the third conductive layers 5 with the fourth conductive layers 6 is stronger than the bonding strength of the second conductive layers 4 with the fourth conductive layers 6. Therefore, it is possible to suppress a portion of the fourth conductive layers 6 that overlaps the second edge 41 from being peeled off, or generation of a crack at that location. Thus it is possible to suppress the entry of external gas, liquid, and the like. Therefore, it is possible to suppress a decrease in the function of the chip resistor A1. In particular, in the present embodiment, the first conductive layers 3 contain Ag. There is a concern that if the Ag is sulfurized by the intrusion of an external gas, liquid, or the like, the first conductive layers 3 may become insulated. According to the present embodiment, it is possible to suppress sulfurization of the first conductive layers 3 and to avoid insulating the first conductive layers 3.

As shown in FIGS. 5 and 6, the second conductive layers 4 include the flake-like carbon particles 402. Thus, the surface of the second conductive layers 4 can be made to have an uneven shape, and the bonding strength between the third conductive layers 5 and the fourth conductive layers 6 can be increased. Further, the carbon particles 402 are suitable for increasing the surface area exposed on the surface of the second conductive layers 4, and it is possible to more reliably provide electrical conductivity of the second conductive layers 4 with the third conductive layers 5 and the fourth conductive layers 6. Also, exposure of the carbon particles 402 is preferable for increasing the bonding strength with the fourth conductive layers 6.

As shown in FIG. 6, the third conductive layers 5 include the metal particles 502 containing flake-like Ag. Thus it is possible to increase the bonding strength between the third conductive layers 5 and the fourth conductive layers 6. Further, since the metal particles 502 are easily exposed from the synthetic resin 501, the metal particles 502 and the carbon particles 402 of the second conductive layers 4 are easily in contact. This is suitable for more reliably providing electrical conductivity between the second conductive layers 4 and the third conductive layers 5.

As shown in FIG. 4, the third edge 51 of the third conductive layers 5 is located between the first edge 93 of the insulating layer 9 and the second edge 41 of the second conductive layers 4. Therefore, even if an external gas, liquid, or the like enters the third edge 51, the insulating layer 9 is interposed between the third edge 51 and the first conductive layers 3. Therefore, even if a liquid or the like permeates downward in the z direction, the insulating layer 9 can prevent the liquid or the like from reaching the first conductive layers 3. Therefore, alteration or the like of the first conductive layers 3 can be prevented. In addition, it is possible to suppress sulfurization of the first conductive layers 3 and to avoid insulating the first conductive layers 3.

When mounting the chip resistor A1 on a circuit substrate or the like of an electronic device or the like, the reverse surface 12 of the substrate 1 is mounted so as to face the circuit substrate. At this time, solder serving as a conductive bonding material adheres to the fifth conductive layers 7. In some cases, it is preferable that the solder adheres to the side surface 73 and the obverse surface 71 in addition to adhering to the reverse surface portion 72 of the fifth conductive layers 7. However, it is not preferable that the solder covers the entire obverse surface portion 71 and reaches the insulating layer 9. In the present embodiment, the peak 76 of the fifth conductive layers 7 is a portion that is farthest from the substrate 1. Thus, it is possible to cause the solder to stay at the peak 76, and it is possible to prevent the solder from reaching the insulating layer 9 beyond the third conductive layers 5. Further, from the viewpoint of providing the peak 76, it is preferable that the third conductive layers 5 have the third bulging portion 52, and the peak 53 is located higher than the peak 43 in the z direction. The portion of the third bulging portion 52 including the peak 53 is thicker than the portion of the second conductive layers 4 covered by the third conductive layers 5. Thus, the peaks 53 and 76 can be located higher. In addition, since the fifth conductive layers 7 have the peak 75, an effect of keeping the solder at the peak 75 can be expected. From the viewpoint of providing the peak 75, it is preferable that the second conductive layers 4 have the second bulging portion 42, and the peak 43 is formed. In addition, since the fifth conductive layers 7 have the concave portion 77, it is possible to cause the solder to stay in the concave portion 77. From the viewpoint of providing the concave portion 77, it is preferable that the second conductive layers 4 have the concave portion 45.

The inclined covering portion 31 of the third conductive layers 5 that cover the inclined surface 15 of the substrate 1 tends to have a surface slightly inclined with respect to the z direction. Next, the curved surface portion 32 is formed of a convex curved surface connected to the inclined covering portion 31. The curved surface portion 44 of the second conductive layers 4 is a convex curved surface following the curved surface portion 32 of the first conductive layers 3, and is a gentler curved surface than the curved surface portion 32. With such a configuration, a portion of the first conductive layers 3 and the second conductive layers 4 that covers the vicinity of the boundary between the inclined surface 15 and the obverse surface 11 of the substrate 1 has a gentle shape without an excessive step or the like. Therefore, the fourth conductive layers 6 and the fifth conductive layers 7 that cover that portion have a gentle shape, and the thickness thereof is likely to be more uniform. Therefore, the portion of the first conductive layers 3 and the second conductive layers 4 that covers the vicinity of the boundary between the inclined surface 15 and the obverse surface 11 can be prevented from being exposed from the fourth conductive layers 6 and the fifth conductive layers 7.

FIGS. 8 to 26 show other embodiments of the present disclosure. In these drawings, the same or similar elements as those in the above embodiment are denoted by the same reference numerals as those in the above embodiment.

Figure 8:
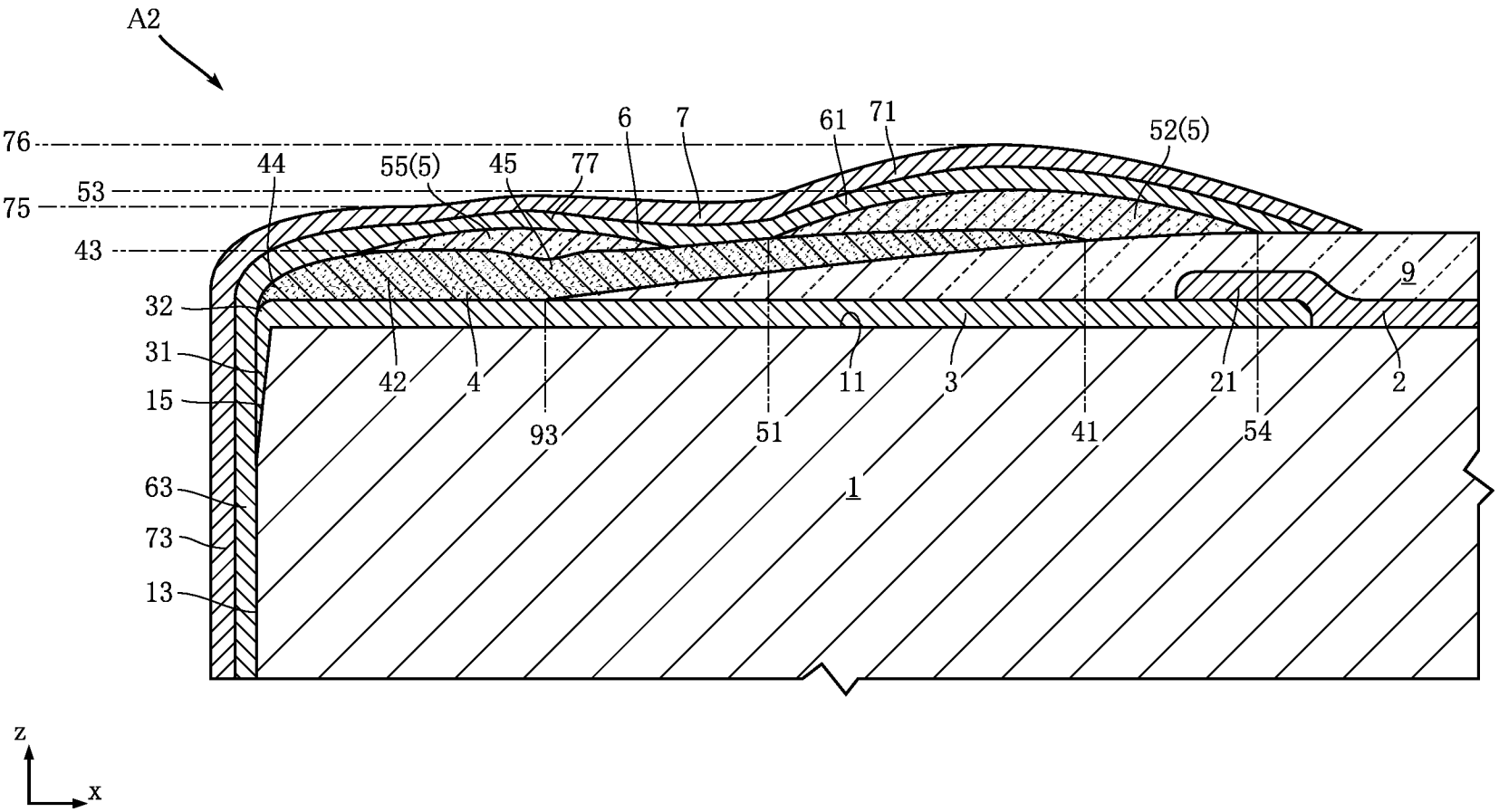
FIG. 8 is a main part enlarged cross-sectional view showing a chip resistor according to a second embodiment of the present disclosure.

FIG. 8 shows a chip resistor according to a second embodiment of the present disclosure. In the chip resistor A2 of the present embodiment, the configuration of the third conductive layers 5 is different than in the above-described embodiment.

In the present embodiment, the third conductive layers 5 have a third bulging portion 52 and a fourth bulging portion 55. Like the third bulging portion 52, the fourth bulging portion 55 is a portion having a shape bulging away from the substrate 1 in the z direction. The fourth bulging portion 55 is separated from the third bulging portion 52 and is located between the fourth bulging portion 55 and the side surface 13 in the x direction. In the example shown, the fourth bulging portion 55 is disposed above the first edge 93 in the z direction, and covers the concave portion 45 of the second conductive layers 4. Also, the fourth bulging portion 55 exposes the curved surface portion 44 of the second conductive layer 4.

According to this sort of embodiment as well, it is possible to suppress a decrease in the function of the chip resistor A2. Further, since the third conductive layers 5 have the fourth bulging portion 55 in addition to the third bulging portion 52, peeling off of the fourth conductive layers 6, or generation of a crack between the fourth conductive layers 6 and the second conductive layers 4 and third conductive layers 5 can be preferably suppressed.

FIGS. 9 to 16 show a chip resistor according to a third embodiment of the present disclosure. The chip resistor A3 of this embodiment has a configuration intended to suppress damage and the like when a surge current flows by extending the conduction path of the resistor layer 2.

Figure 9:
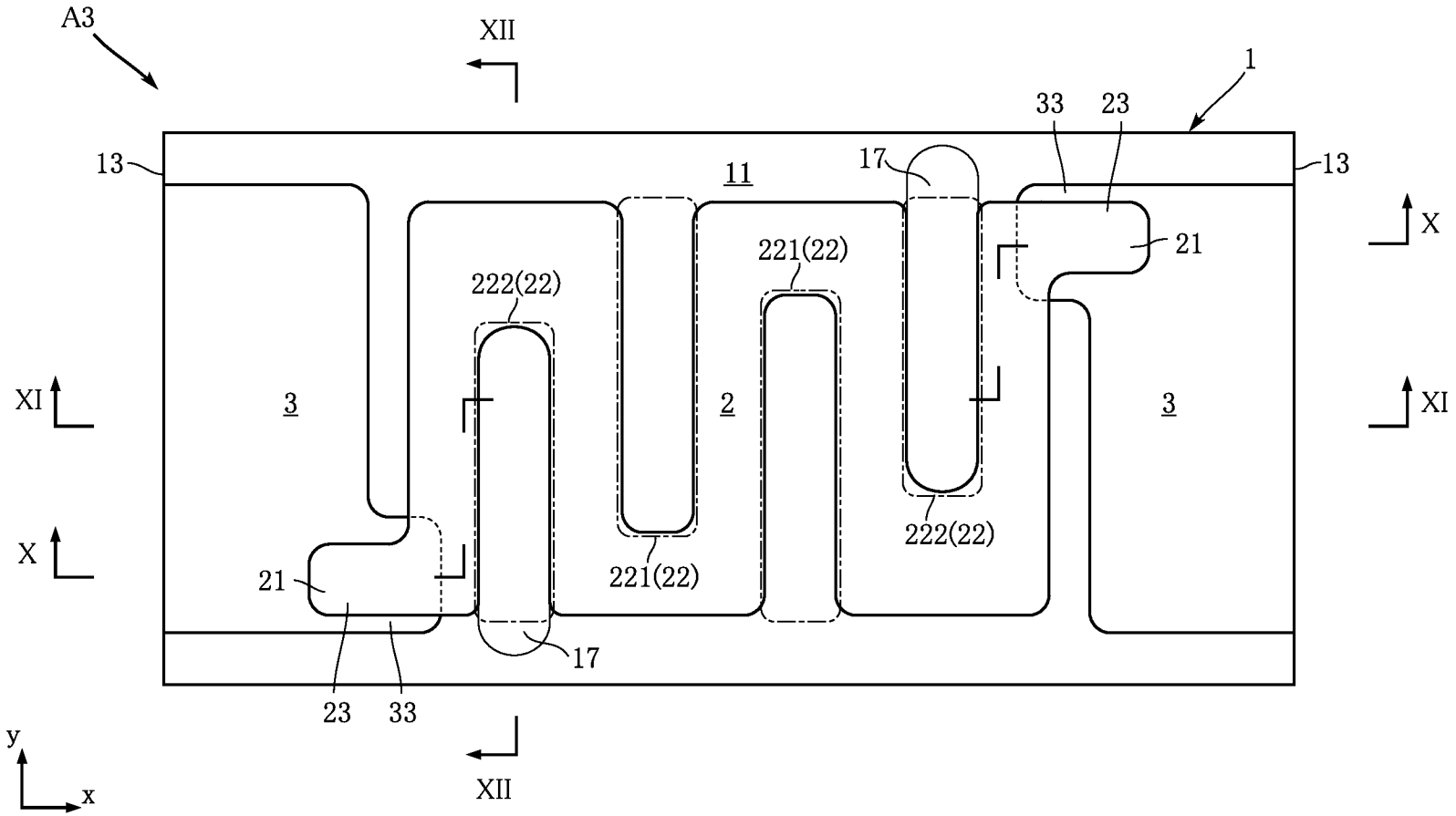
FIG. 9 is a main part plan view showing a chip resistor according to a third embodiment of the present disclosure.
Figure 10:
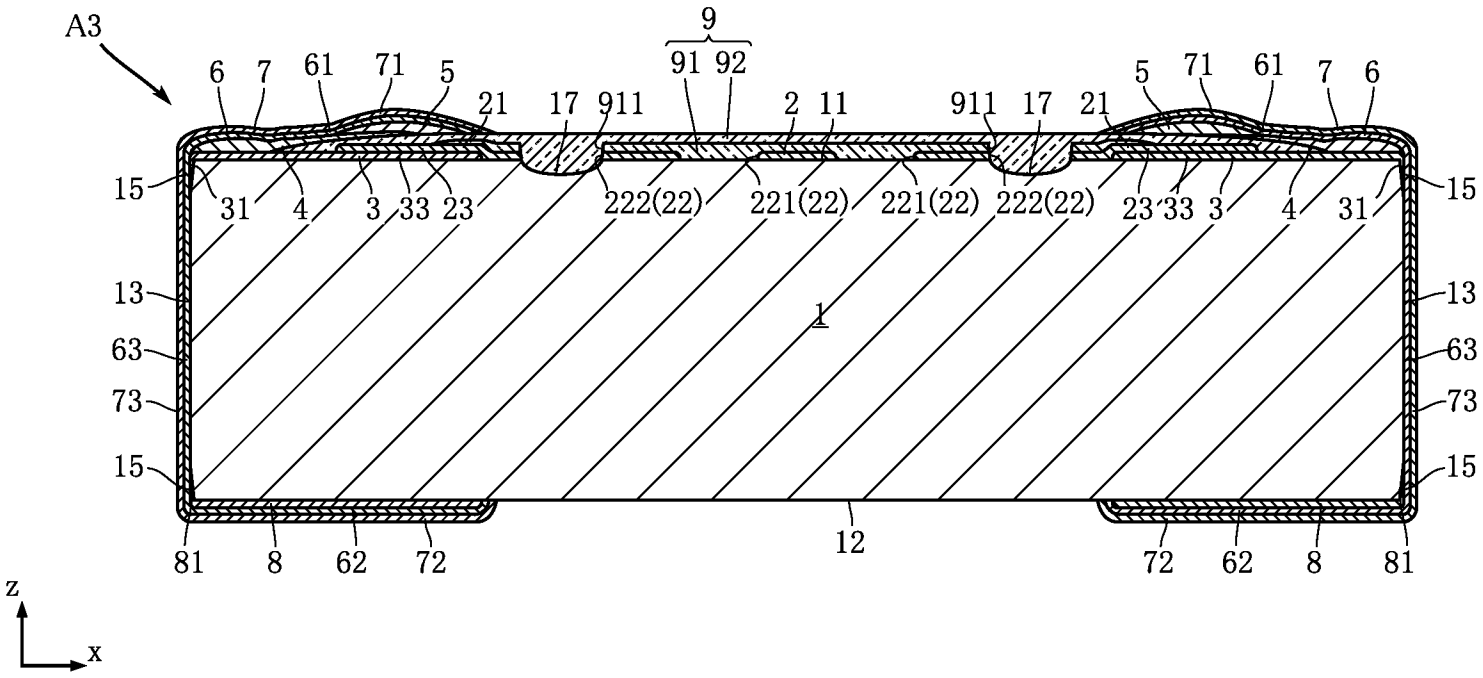
FIG. 10 is a cross-sectional view taken along line X-X in FIG. 9.
Figure 11:
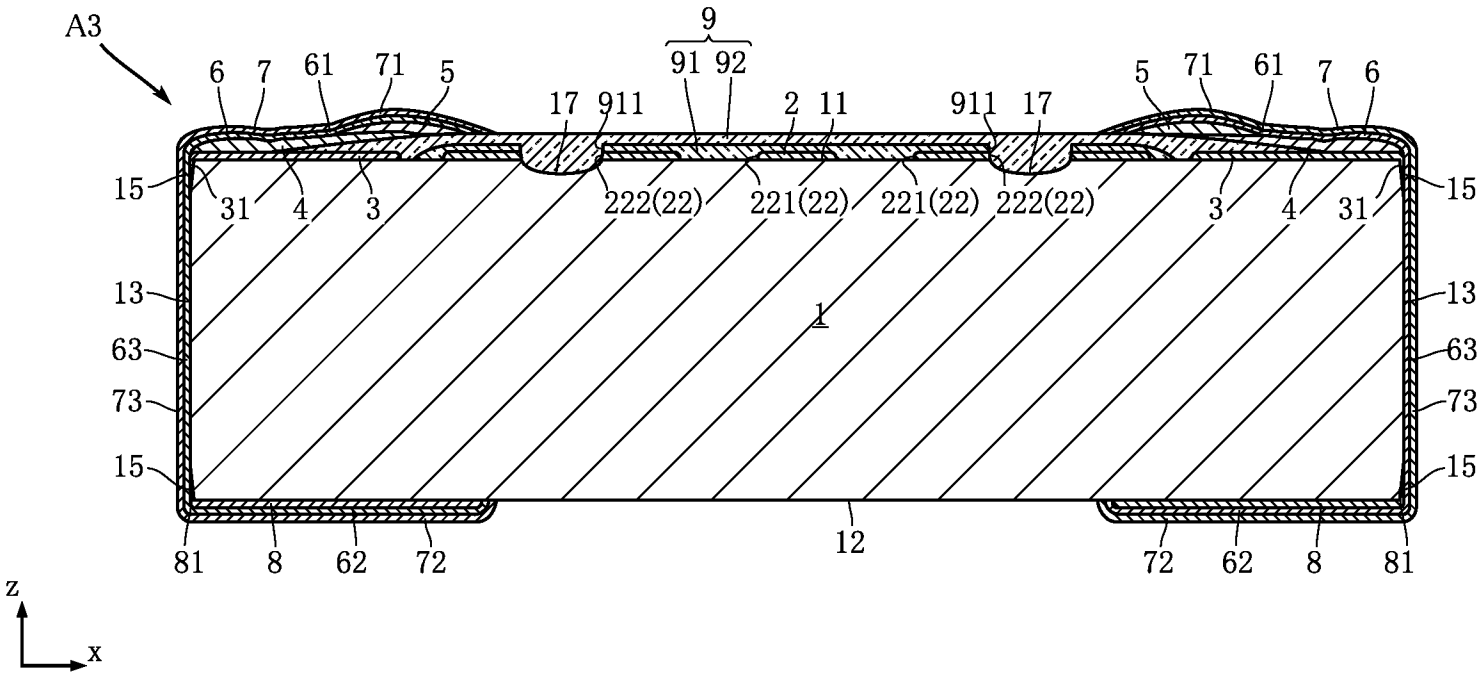
Figure 12:
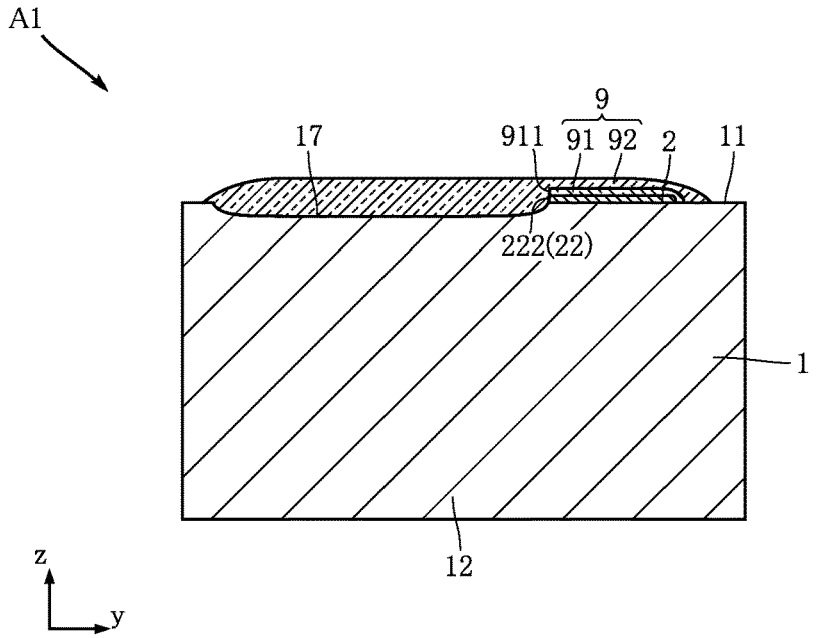
FIG. 12 is a cross-sectional view taken along line XII-XII in FIG. 9.
Figure 13:
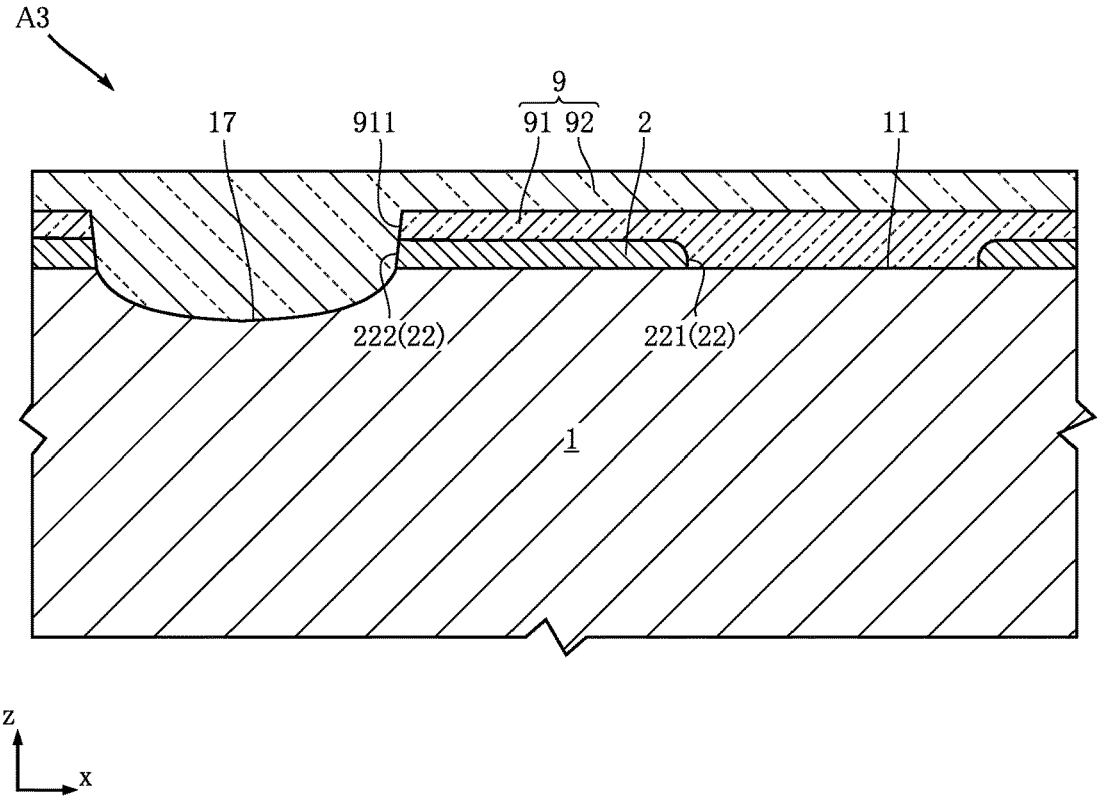
FIG. 13 is a main part enlarged cross-sectional view showing a chip resistor according to a third embodiment of the present disclosure.
Figure 14:
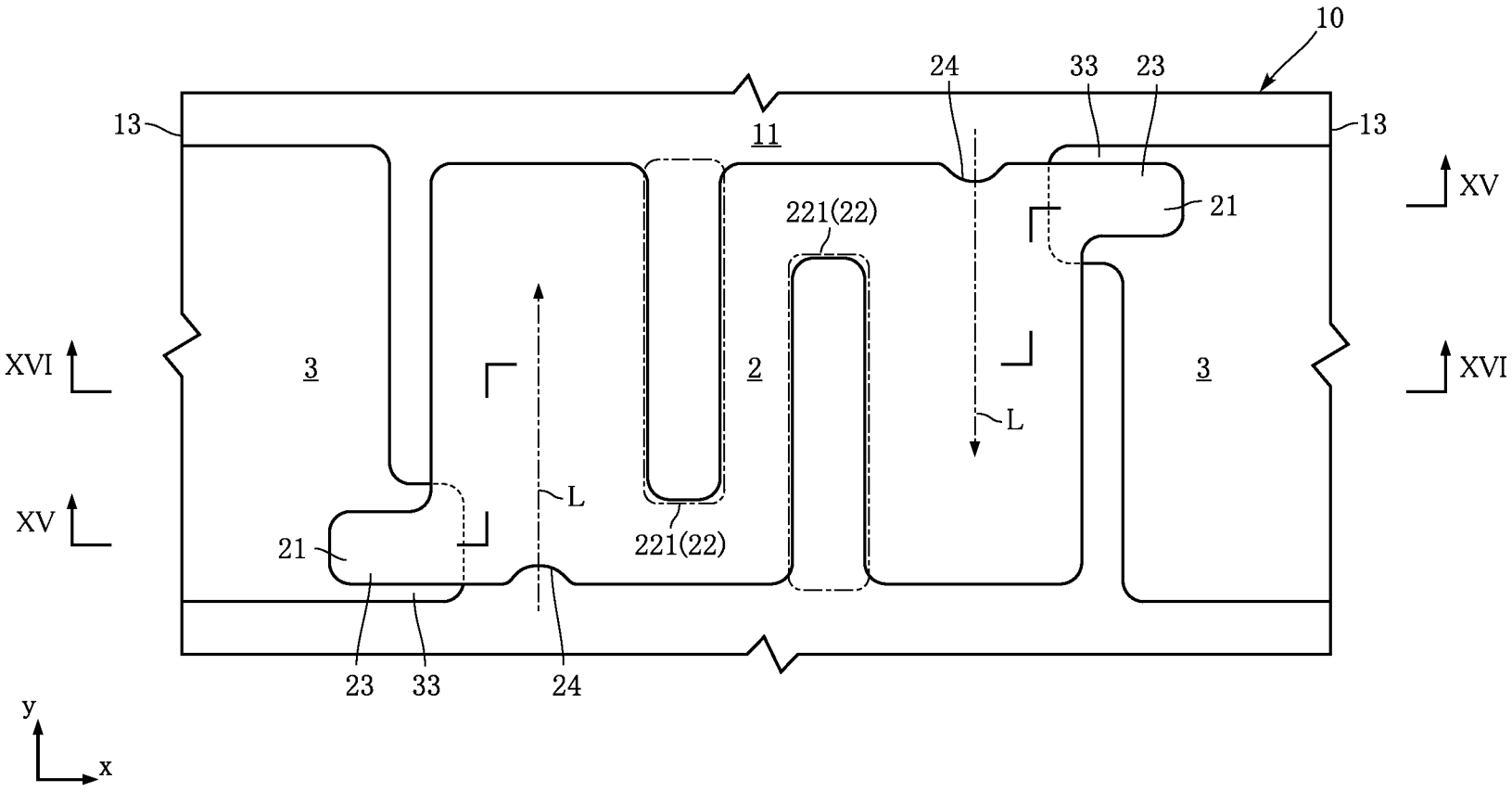
FIG. 14 is a plan view showing a manufacturing process of the chip resistor according to a third embodiment of the present disclosure.
Figure 15:
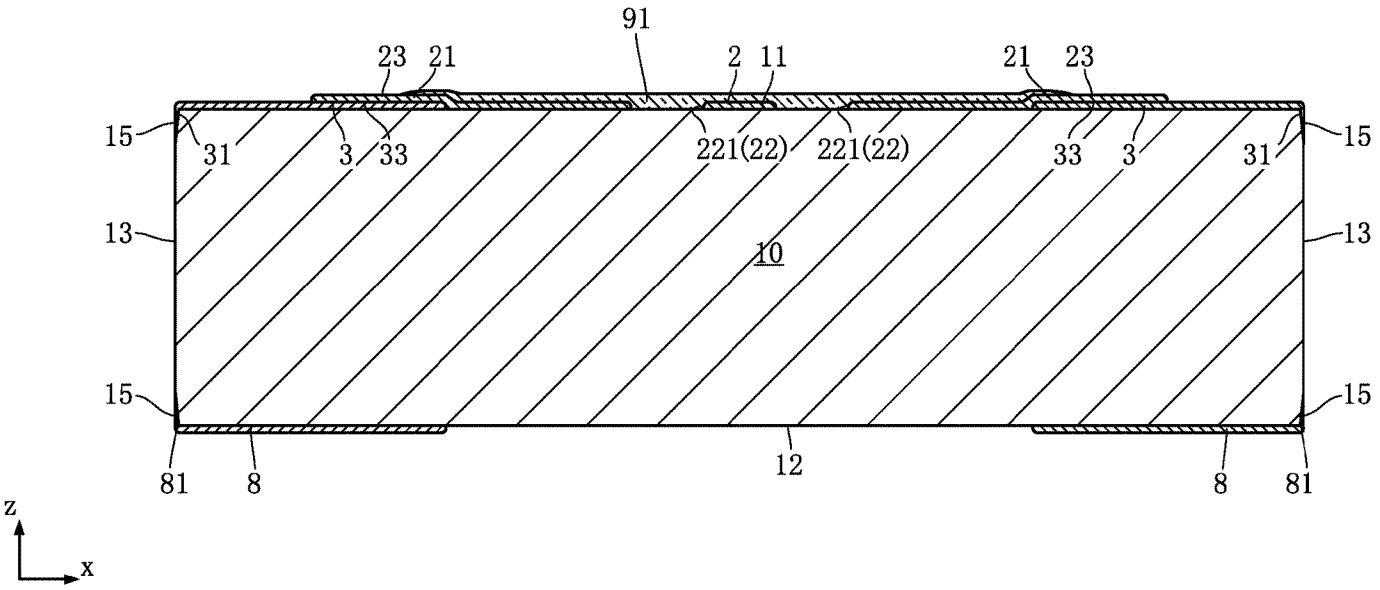
FIG. 15 is a cross-sectional view taken along line XV-XV in FIG. 14.
Figure 16:
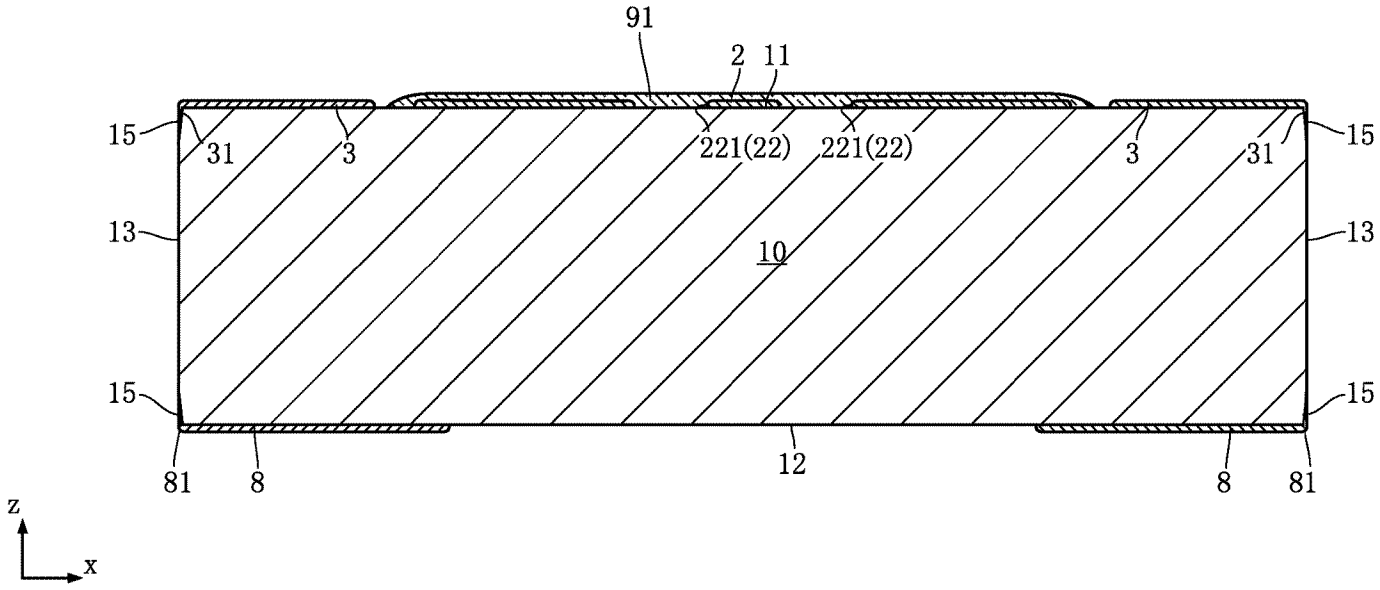
FIG. 16 is a cross-sectional view taken along line XVI-XVI in FIG. 14.
Figure 17:
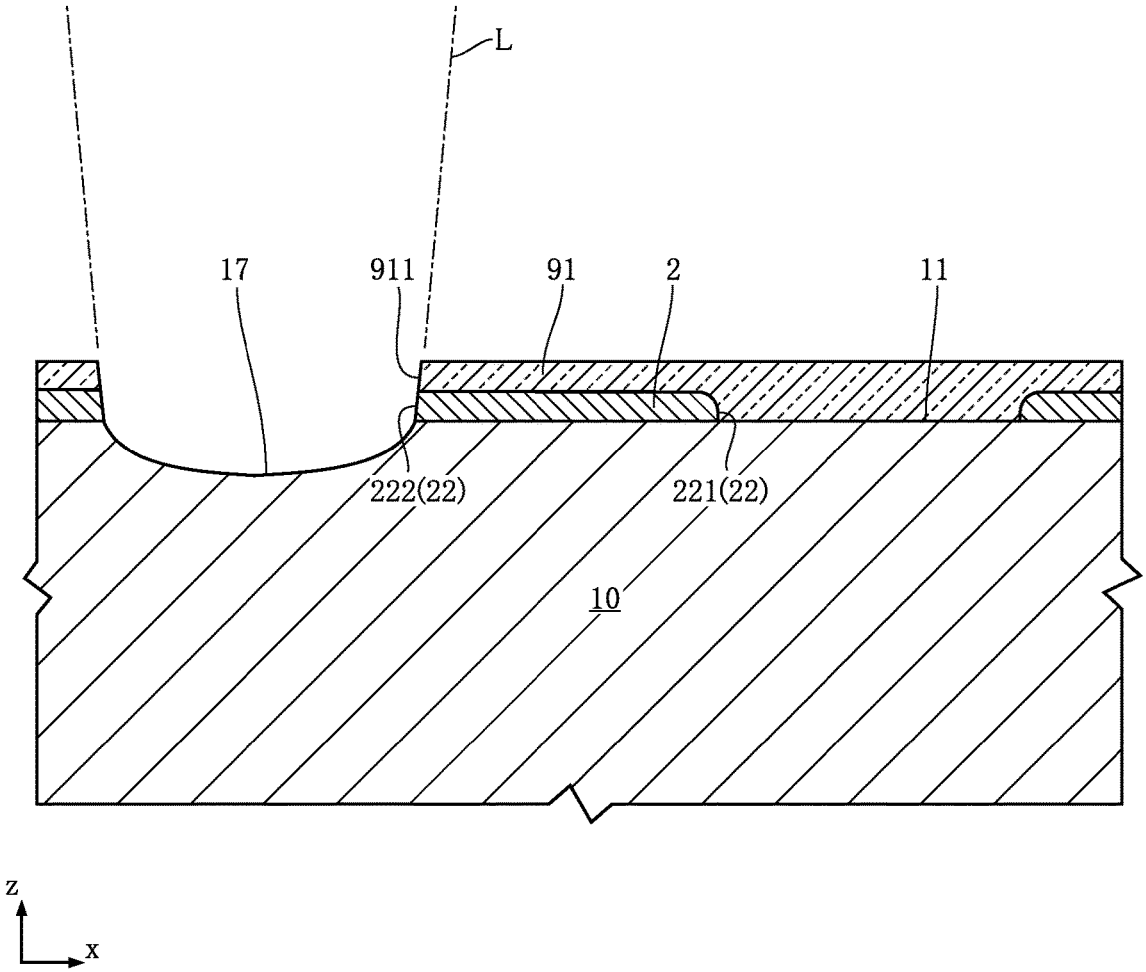
FIG. 17 is a main part enlarged cross-sectional view showing a manufacturing process of the chip resistor according to a third embodiment of the present disclosure.

FIG. 9 is a main part plan view showing the chip resistor A3. FIG. 10 is a cross-sectional view taken along line X-X in FIG. 9. FIG. 11 is a cross-sectional view taken along line XI-XI in FIG. 9. FIG. 12 is a cross-sectional view taken along line XII-XII in FIG. 9. FIG. 13 is a main part enlarged cross-sectional view showing the chip resistor A3. FIG. 14 is a plan view showing a manufacturing process of the chip resistor A3. FIG. 15 is a cross-sectional view taken along line XV-XV in FIG. 14. FIG. 16 is a cross-sectional view taken along line XVI-XVI in FIG. 14. FIG. 17 is a main part enlarged cross-sectional view showing a manufacturing process of the chip resistor A3.

In the present embodiment, the first conductive layers 3 have an extending portion 33. The extending portion 33 is a portion extending toward the center in the x direction. The resistor layer 2 has an extending portion 23. The extending portion 23 is a portion that extends outward in the x direction. The portion of the extending portion 23 that overlaps the extending portion 33 is the covering portion 21.

The resistor layer 2 has a plurality of grooves 22. Each groove 22 is an elongated notch portion that is formed in a shape that enters toward the inside of the resistor layer 2.

Note that, for convenience of understanding, in these drawings, the grooves 22 are surrounded by a dashed line, and this is also true in the following drawings. In the present embodiment, each of the thin grooves 22 has an elongated shape whose longitudinal direction is the y direction. The plurality of grooves 22 are provided alternately on the upper side in the y direction view and on the lower side in the y direction view. By providing such a plurality of grooves 22, the resistor layer 2 has a meandering shape, and the conduction path is extended as compared with the resistor layer 2 of the chip resistor A1. Each of the plurality of grooves 22 extends in the y direction.

In the present embodiment, the plurality of grooves 22 include first grooves 221 and second grooves 222. As shown in FIGS. 9 and 13, the first grooves 221 expose the obverse surface 11. The second grooves 222 match with groove portions 17 formed in the substrate 1 when viewed in the z direction. As shown in FIGS. 10 to 12, the groove portions 17 are recessed from the obverse surface 11, and in the example shown, have a slender shape having the y direction as their longitudinal direction. In the example shown, two of the first grooves 221 are disposed near the center in the x direction, and two of the second grooves 222 are disposed outward in the x direction. The two first grooves 221 are provided on opposite sides of each other in the y direction, and the two second grooves 222 are provided on opposite sides of each other in the y direction.

In the present embodiment, the insulating layer 9 has a first insulating layer 91 and a second insulating layer 92. The first insulating layer 91 directly covers the substrate 1 and the resistor layer 2. The second insulating layer 92 covers the first insulating layer 91, and the resistor layer 2 and the first conductive layers 3 located near the first insulating layer 91. As shown in FIGS. 10 and 11, the first insulating layer 91 covers most of the resistor layer 2 except for a part of the extending portion 23 of the resistor layer 2, and does not cover the first conductive layers 3. The material of the first insulating layer 91 and the second insulating layer 92 is not particularly limited. In the example shown, the first insulating layer 91 is made of, for example, glass, and the second insulating layer 92 is made of an epoxy resin. In forming the insulating layer 9, for example, a glass paste is printed and then baked to form the first insulating layer 91, and a paste containing an epoxy resin as a main component is printed so as to cover the first insulating layer 91 and then baked. Thus, the second insulating layer 92 is formed.

As shown in FIG. 13, a portion of the obverse surface 11 exposed from the first grooves 221 is covered by the first insulating layer 91. On the other hand, as shown in FIGS. 10 to 12, the first insulating layer 91 has grooves 911. The grooves 911 are opening portions that entirely match the groove portions 17 of the substrate 1 when viewed in the z direction. That is, the groove portions 17, the second grooves 222, and the grooves 911 match each other when viewed in the z direction. Therefore, the groove portions 17 are not covered by the first insulating layer 91, but are covered by the second insulating layer 92. In other words, the second insulating layer 92 fills the second grooves 222 of the resistor layer 2 and the groove portions 17 of the substrate 1 through the grooves 911 of the first insulating layer 91. The inner surfaces of the groove portions 17, the second grooves 222, and the grooves 911 are smoothly connected to each other without any step or the like between them.

FIGS. 14 to 17 show an example of a manufacturing process of the chip resistor A3. In this example, a substrate material 10 capable of forming a plurality of substrates 1 is used. As shown in FIGS. 14 to 16, the resistor layer 2, the first conductive layers 3, and the first insulating layer 91 are formed on the obverse surface 11 of the substrate material 10 by printing and baking. Note that in FIG. 14, the first insulating layer 91 is omitted for convenience of understanding. The resistor layer 2 has two grooves 22 and two concave portions 24. Each of the two grooves 22 is a first groove 221. The groove portions 17 described above are not yet formed in the substrate 1. The location of the substrate 1 where the groove portions 17 are provided is covered by the resistor layer 2 and the first insulating layer 91. That is, the resistor layer 2 does not have the second grooves 222, and the first insulating layer 91 does not have the grooves 911. In the example shown, the two concave portions 24 are used to indicate where second grooves 222 are to be formed in a process described later.

Next, as shown in FIGS. 14 and 17, the resistor layer 2 is trimmed using a laser beam L. The purpose of the trimming is, for example, to extend the conduction path of the resistor layer 2 and to adjust the resistance value of the resistor layer 2. As shown in FIG. 14, the laser beam L is scanned from the concave portion 24 to the path indicated by the arrow. Thereby, as shown in FIG. 17, the portion of the first insulating layer 91 and the resistor layer 2 irradiated with the laser beam L is removed over the entire thickness. Further, the portion of the substrate 1 irradiated with the laser beam L is removed. As a result, the groove portions 17 are formed in the substrate 1, and the second grooves 222 and the grooves 911 are formed in the resistor layer 2 and the first insulating layer 91. By adopting such a technique, the groove portions 17, the second grooves 222, and the grooves 911 match each other when viewed in the z direction. Also, the inner surfaces of the groove portion 17, the second grooves 222, and the grooves 911 are smoothly connected to each other without any step or the like between them.

According to this sort of embodiment as well, it is possible to suppress a decrease in the function of the chip resistor A3. Further, since the conduction path of the resistor layer 2 is extended, it is possible to suppress damage and the like when a surge current flows.

FIGS. 18 to 23 show a chip resistor according to a fourth embodiment of the present disclosure.

Figure 18:
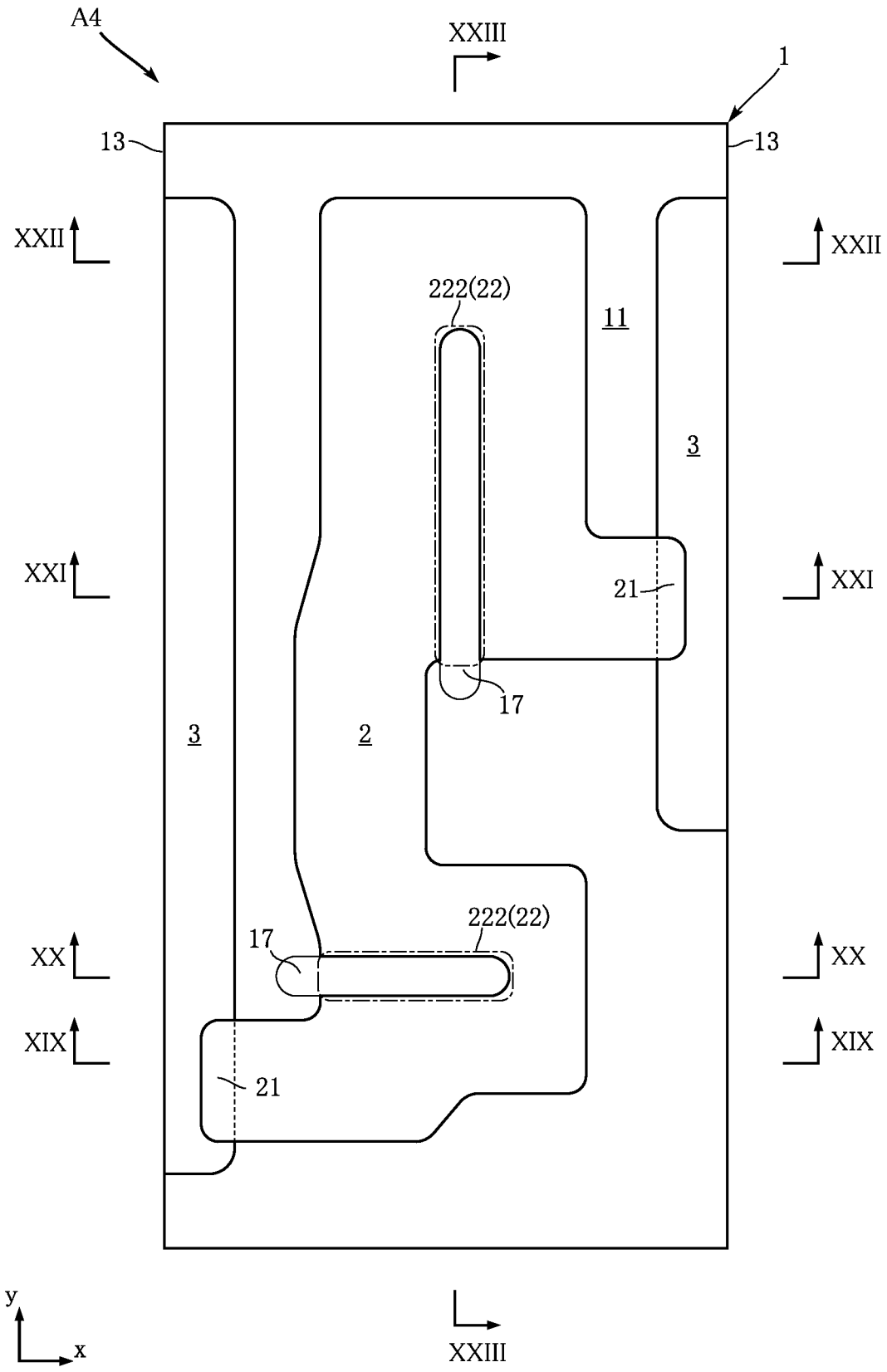
FIG. 18 is a main part plan view showing a chip resistor according to a fourth embodiment of the present disclosure.
Figure 19:
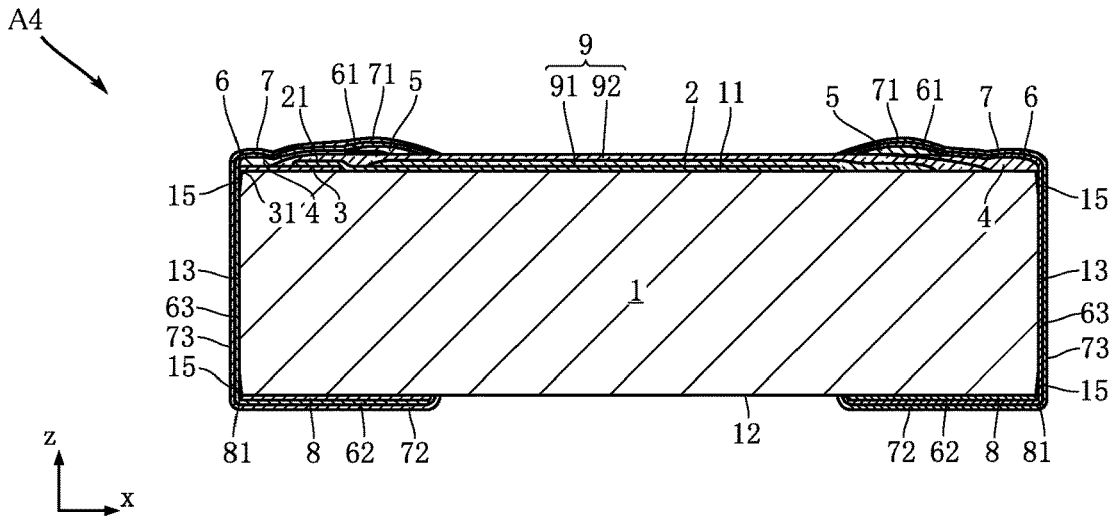
FIG. 19 is a cross-sectional view taken along line XIX-XIX in FIG. 18.
Figure 20:
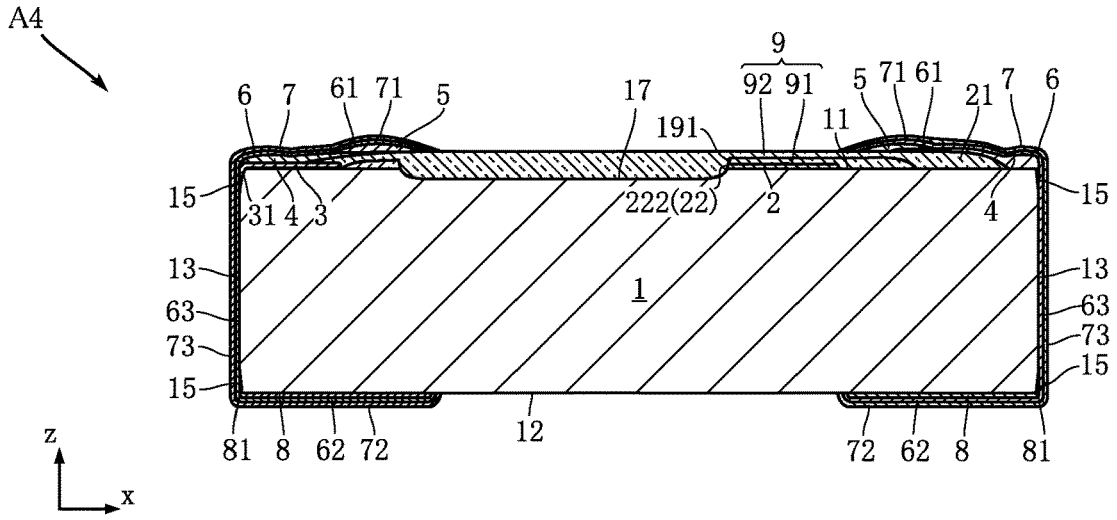
FIG. 20 is a cross-sectional view taken along line XX-XX in FIG. 18.
Figure 21:
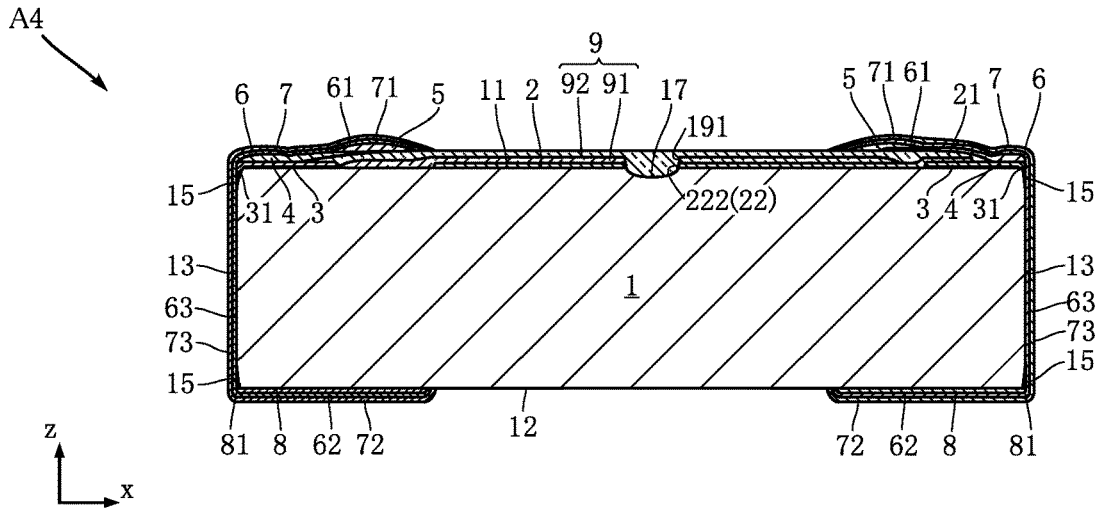
FIG. 21 is a cross-sectional view taken along line XXI-XXI in FIG. 18.
Figure 22:
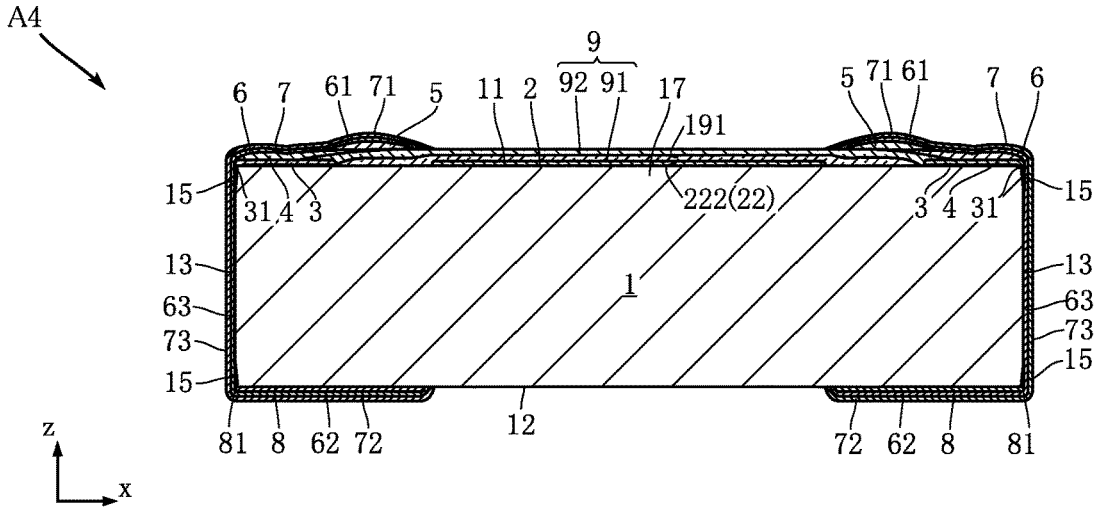
FIG. 22 is a cross-sectional view taken along line XXII-XXII in FIG. 18.

FIG. 18 is a main part plan view showing a chip resistor A4. FIG. 19 is a cross-sectional view taken along line XIX-XIX in FIG. 18. FIG. 20 is a cross-sectional view taken along line XX-XX in FIG. 18. FIG. 21 is a cross-sectional view taken along line XXI-XXI in FIG. 18. FIG. 22 is a cross-sectional view taken along line XXII-XXII in FIG. 18. FIG. 23 is a cross-sectional view taken along line XXIII-XXIII in FIG. 18. Note that in FIG. 18, components other than the substrate 1, the resistor layer 2, and the first conductive layers 3 are omitted for convenience of understanding.

For the chip resistor A4 of this embodiment, the ratio of the dimension in the x direction and the dimension in the y direction when viewed in the z direction differs from the chip resistors A1 to A3. In this embodiment, the dimension of the chip resistor A4 in the y direction is longer than the dimension in the x direction.

The pair of first conductive layers 3 are provided on both sides in the x direction on the obverse surface 11 of the substrate 1. The first conductive layer 3 on the right side of the drawing in FIG. 18 has a shorter dimension in the y direction than the first conductive layer 3 on the left side of the drawing, and is disposed shifted upward in the drawing in the y direction.

Similar to the above-described chip resistor A3, also in this embodiment, the conduction path of the resistor layer 2 is extended. The resistor layer 2 has a plurality of grooves 22. In the present embodiment, the plurality of grooves 22 include only the second grooves 222, but may also include the first grooves 221 described above. The two second grooves 222 include a second groove 222 having its longitudinal direction in the x direction and a second groove 222 having its longitudinal direction in the y direction. As shown in FIGS. 18, 20, 21, and 23, the second grooves 222 match the groove portions 17 of the substrate 1 when viewed in the z direction. Also, the second grooves 222 match the grooves 911 of the first insulating layer 91 when viewed in the z direction. Such second grooves 222 can be formed by, for example, a technique similar to the technique shown in FIG. 17.

According to this sort of embodiment as well, it is possible to suppress a decrease in the function of the chip resistor A4. Further, since the conduction path of the resistor layer 2 is extended, it is possible to suppress damage and the like when a surge current flows.

Figure 25:
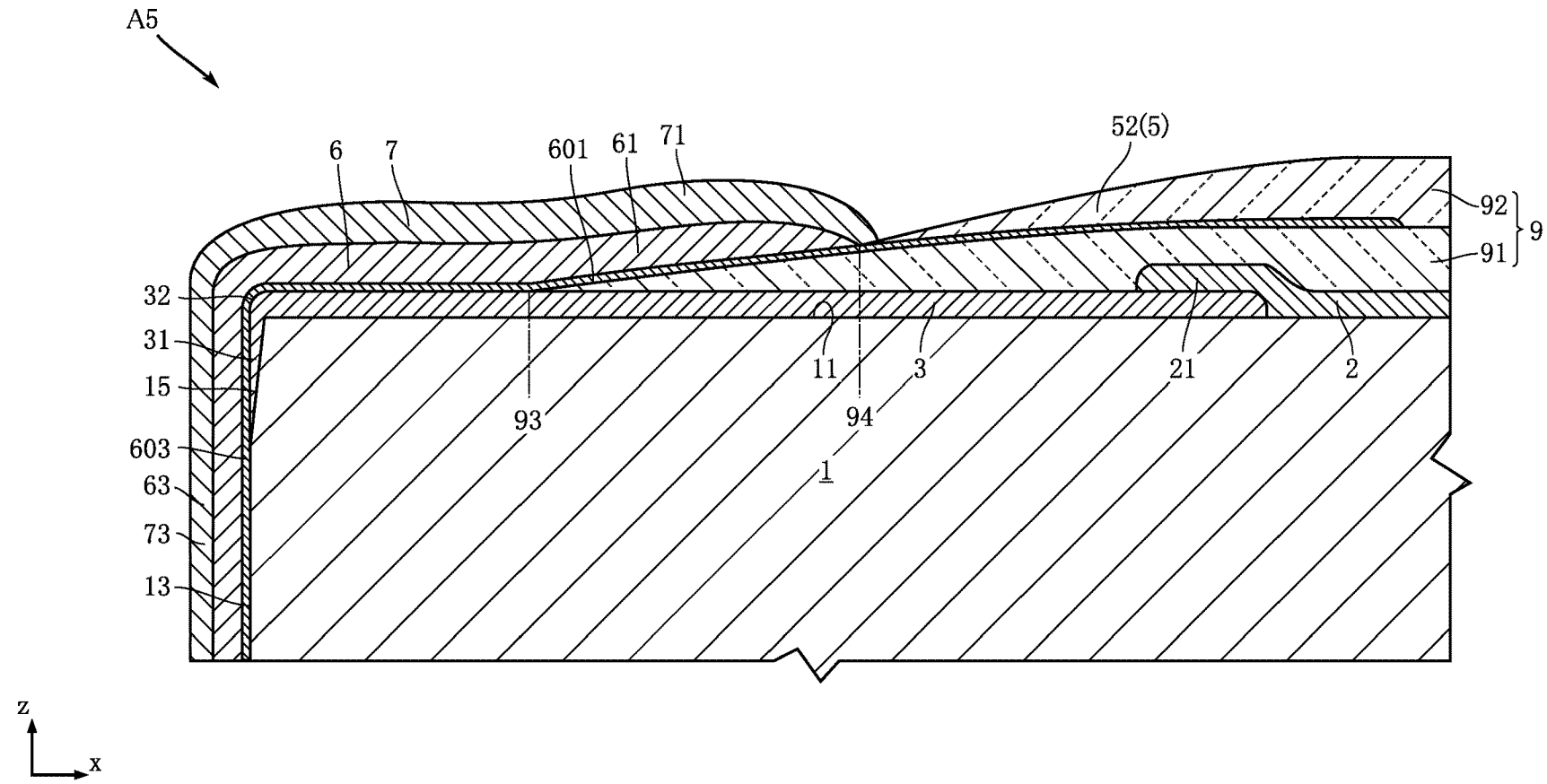
FIG. 25 is a main part enlarged cross-sectional view showing the chip resistor according to a fifth embodiment of the present disclosure.
Figure 26:
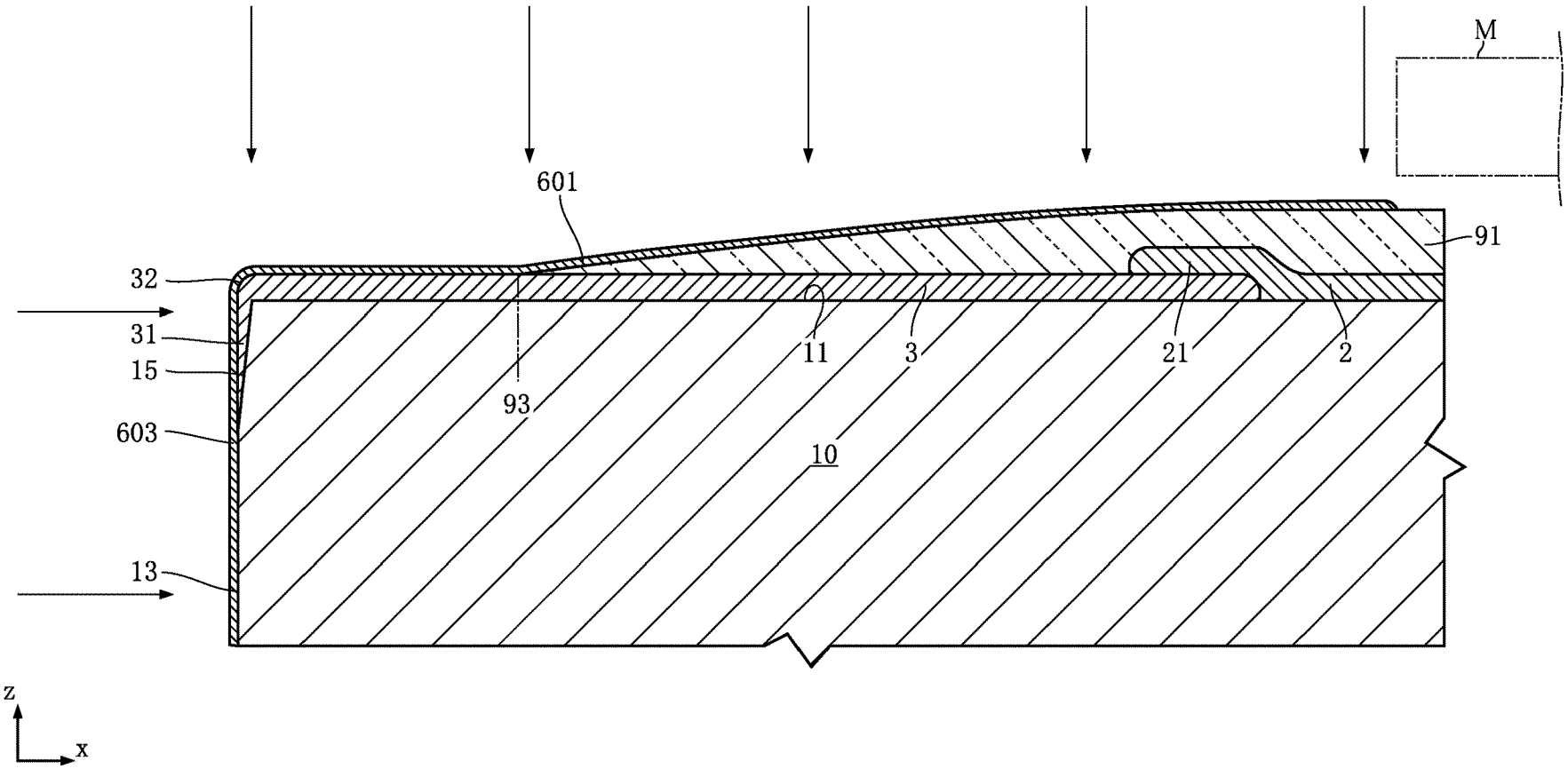
FIG. 26 is a main part enlarged cross-sectional view showing a manufacturing process of the chip resistor according to a fifth embodiment of the present disclosure.

FIGS. 24 to 26 show a chip resistor according to a fifth embodiment of the present disclosure.

FIG. 24 is a cross-sectional view showing a chip resistor A5. FIG. 25 is a main part enlarged cross-sectional view showing the chip resistor A5. FIG. 26 is a main part enlarged cross-sectional view showing a manufacturing process of the chip resistor A5.

As shown in FIGS. 24 and 25, the chip resistor A5 includes a substrate 1, a resistor layer 2, first conductive layers 3, an underlying conductive layer 60, fourth conductive layers 6, and fifth conductive layers 7. The configurations of the substrate 1, the resistor layer 2, and the first conductive layers 3 are similar to those of the above-described chip resistor A1, for example. The insulating layer 9 has a first insulating layer 91 and a second insulating layer 92, similar to those of the above-described chip resistors A3 and A4.

The underlying conductive layer 60 is made of a metal layer, for example, a Ni layer formed by sputtering. The thickness of the underlying conductive layer 60 is not particularly limited, and is, for example, 300 nm to 700 nm. The underlying conductive layer 60 has an obverse surface portion 601, a reverse surface portion 602, and a side surface portion 603.

The obverse surface portion 601 is supported by the obverse surface 11 of the substrate 1 through the resistor layer 2, the first conductive layers 3, and the first insulating layer 91. The obverse surface portion 601 covers the first insulating layer 91 and the first conductive layers 3 while straddling over the first edge 93 of the first insulating layer 91. The reverse surface portion 602 is supported on the reverse surface 12 of the substrate 1 through the sixth conductive layers 8. The reverse surface portion 602 covers a part of the sixth conductive layers 8. The side surface portion 603 is supported by the side surface 13, and covers the side surface 13 and the inclined covering portion 31 of the first conductive layers 3.

As shown in FIG. 25, the second insulating layer 92 covers a part of the obverse surface portion 601 of the underlying conductive layer 60. The fifth edge 94 of the second insulating layer 92 is located on the obverse surface portion 601, and is located closer to the center in the x direction than the first edge 93.

The obverse surface portion 61 of the fourth conductive layers 6 covers a portion of the obverse surface portion 601 of the underlying conductive layer 60 that is exposed from the second insulating layer 92. That is, the obverse surface portion 61 is provided substantially outside in the x direction with respect to the fifth edge 94 of the second insulating layer 92.

The obverse surface portion 71 of the fifth conductive layers 7 covers the obverse surface portion 61 of the fourth conductive layers 6. The obverse surface portion 71 can cover a part of the second insulating layer 92 near the fifth edge 94, but exposes most of the second insulating layer 92.

FIG. 26 shows an example manufacturing process of the chip resistor A5. The resistor layer 2, the first conductive layers 3, and the first insulating layer 91 are formed on the substrate material 10 by using, for example, printing and baking. Next, in a state in which a part of the first insulating layer 91 is exposed using a mask M, the underlying conductive layer 60 is formed by sputtering. Thus, the obverse surface portion 601 of the underlying conductive layer 60 has a configuration that partially covers the first insulating layer 91. Thereafter, the second insulating layer 92 is formed so as to cover the first insulating layer 91 and a part of the obverse surface portion 601 of the underlying conductive layer 60. Then, by sequentially forming the fourth conductive layers 6 and the fifth conductive layers 7, the chip resistor A5 is obtained.

According to this sort of embodiment, the second insulating layer 92 of the insulating layer 9 and the obverse surface portion 61 of the fourth conductive layers 6 are joined to the obverse surface portion 601 of the underlying conductive layer 60 with the fifth edge 94 interposed therebetween. Since the underlying conductive layer 60 is formed using sputtering, the area where the underlying conductive layer 60 is formed is likely to have a fine rough surface having fine irregularities. Therefore, it is possible to increase the bonding strength of the first insulating layer 91 to the second insulating layer 92 and the obverse surface portion 61, and to suppress external gas, liquid, or the like from entering inside from the fifth edge 94. Therefore, it is possible to suppress a decrease in the function of the chip resistor A5. In addition, it is possible to suppress sulfurization of the first conductive layers 3 and to avoid insulating the first conductive layers 3.

The chip resistor according to the present disclosure is not limited to the above-described embodiments. Various design modifications can be made to the specific configuration of each part of the chip resistor according to the present disclosure.

The invention claimed is:

1. A chip resistor comprising:

a substrate having an obverse surface and a reverse surface facing opposite to each other in a thickness direction, and having a side surface located between the obverse surface and the reverse surface:

a resistor layer disposed on the obverse surface;

a first conductive layer disposed on the obverse surface and electrically connected to the resistor layer;

an insulating layer that covers the resistor layer and the first conductive layer, and has a first edge located on the first conductive layer;

a second conductive layer that covers the first conductive layer and the insulating layer while straddling over the first edge, and has a second edge located on the insulating layer;

a third conductive layer that covers the second conductive layer and the insulating layer while straddling over the second edge, and has a third edge located on the second conductive layer; and a fourth conductive layer that covers the second conductive layer and the third conductive layer while straddling over the third edge, wherein bonding strength between the third conductive layer and the fourth conductive layer is stronger than bonding strength between the second conductive layer and the fourth conductive layer.

2. The chip resistor according to claim 1, wherein the first conductive layer contains Ag.

3. The chip resistor according to claim 1 or 2, wherein the second conductive layer contains a synthetic resin and carbon.

4. The chip resistor according to claim 3, wherein the carbon contained in the second conductive layer is flake-like.

5. The chip resistor according to claim 1, wherein the third conductive layer contains a synthetic resin and Ag.

6. The chip resistor according to claim 5, wherein the Ag contained in the third conductive layer is flake-like.

7. The chip resistor according to claim 1, wherein the third edge is located between the first edge and the second edge.

8. The chip resistor according to claim 7, wherein the third conductive layer has a fourth edge located on the insulating layer.

9. The chip resistor according to claim 8, wherein the fourth conductive layer covers the fourth edge.

10. The chip resistor according to claim 1, wherein the second conductive layer has a second bulging portion between the side surface of the substrate and the first edge of the insulating layer, the second bulging portion bulging away from the obverse surface of the substrate.

11. The chip resistor according to claim 10, wherein the third conductive layer has a third bulging portion of the substrate that bulges away from the substrate.

12. The chip resistor according to claim 11, wherein a peak of the third bulging portion is further away from the obverse surface of the substrate than a peak of the second bulging portion.

13. The chip resistor according to claim 1, wherein the fourth conductive layer contains Ni.

14. The chip resistor according to claim 1, further comprising a fifth conductive layer that covers the fourth conductive layer.

15. The chip resistor according to claim 14, wherein the fifth conductive layer contains Sn.

16. The chip resistor according to claim 1, wherein the resistor layer is formed with a plurality of grooves.

17. The chip resistor according to claim 16, wherein the plurality of grooves include:

a first groove that exposes the obverse surface of the substrate, and a second groove that, as viewed in the thickness direction, matches a groove portion formed on the substrate and recessed from the obverse surface.

18. The chip resistor according to claim 16, wherein said first conductive layer comprises a pair of first conductive layers spaced apart from each other in a first direction, and the plurality of grooves extend along a second direction perpendicular to the first direction.

19. The chip resistor according to claim 16, wherein said first conductive layer comprises a pair of first conductive layers spaced apart from each other in a first direction, and the plurality of grooves include a groove that extends along the first direction and another groove that extends along a second direction perpendicular to the first direction.

* * * * *